US007199780B2

(12) United States Patent
Sekine

(10) Patent No.: US 7,199,780 B2
(45) Date of Patent: Apr. 3, 2007

(54) FIELD SEQUENTIAL DRIVING TYPE LIQUID CRYSTAL DISPLAY APPARATUS CAPABLE OF INCREASING BRIGHTNESS WHILE SUPPRESSING IRREGULARITY, AND ITS DRIVING METHOD

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 616 days.

(21) Appl. No.: 10/457,374

(22) Filed: Jun. 10, 2003

(65) Prior Publication Data

US 2004/0017342 A1 Jan. 29, 2004

(30) Foreign Application Priority Data

Jul. 25, 2002 (JP) ..... 2002-217251

(51) Int. Cl.
*G09G 3/36* (2006.01)

(52) U.S. Cl. ..... 345/102; 345/42; 345/63; 345/87; 345/690; 349/61

(58) Field of Classification Search ..... 345/42, 345/46, 63, 77, 87, 100, 102, 690
See application file for complete search history.

(56) References Cited

U.S. PATENT DOCUMENTS 6,803,901 B1 * 10/2004 Numao ..... 345/102
2002/0196220 A1 * 12/2002 Sato et al. ..... 345/87

* cited by examiner

*Primary Examiner*—Bipin Shalwala
*Assistant Examiner*—Vincent E. Kovalick
(74) *Attorney, Agent, or Firm*—Young & Thompson

(57) ABSTRACT

In a sequential driving method for time-divisionally displaying a plurality of color signals in respective ones of sub-frames forming one frame in a liquid crystal display apparatus including a plurality of data lines, gate lines, and liquid crystal pixels each including a liquid crystal cell and a switching element, black signals are written into all of the liquid crystal pixels at a beginning period of each sub-frame. Then, one color signal is sequentially written into rows of the liquid crystal pixels while the gate lines are sequentially selected. Finally, one backlight corresponding to one of the color signals is turned ON at an end period of each sub-frame. In this case, a level of pixel components of one color signal to be written into one row is compensated for, so that a change of an average transmittivity of each row is sufficiently small before the end period.

32 Claims, 28 Drawing Sheets

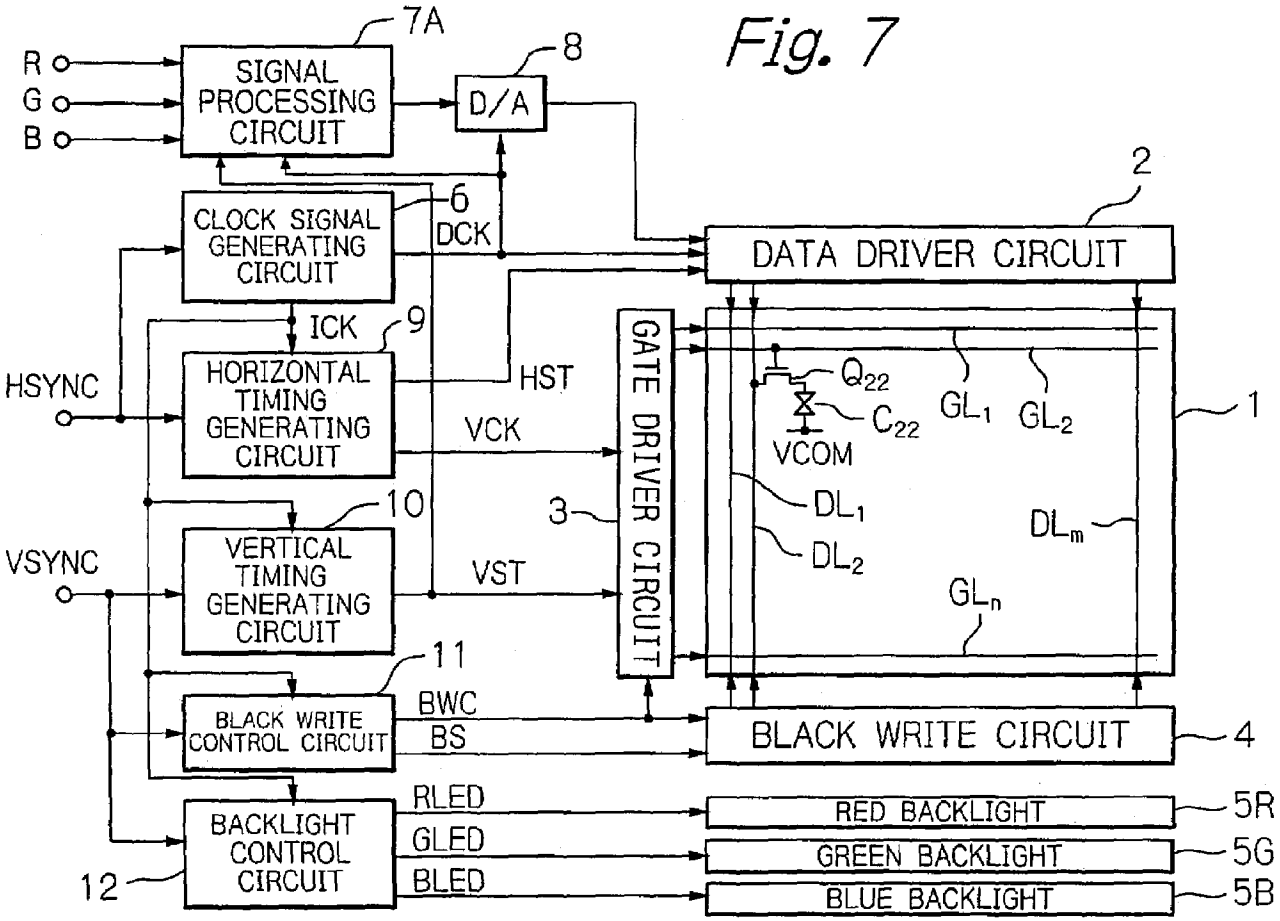
Fig. 7
DATA DRIVER CIRCUIT
GATE DRIVER CIRCUIT
BLACK WRITE CIRCUIT
RED BACKLIGHT
GREEN BACKLIGHT
BLUE BACKLIGHT
SIGNAL PROCESSING CIRCUIT
CLOCK SIGNAL GENERATING CIRCUIT
HORIZONTAL TIMING GENERATING CIRCUIT
VERTICAL TIMING GENERATING CIRCUIT
BLACK WRITE CONTROL CIRCUIT
BACKLIGHT CONTROL CIRCUIT
D/A
R
G
B
HSYNC
VSYNC
DCK
ICK
HST
VCK
VST
BWC
BS
RLED
GLED
BLED
VCOM
1
2
3
4
5R
5G
5B
6
7A
8
9
10
11
12

| j \ i | 1 | 2 | ------ | m | $C_j$ |
|---|---|---|---|---|---|
| 1 | $P_{11}$ | $P_{21}$ | ------ | $P_{m1}$ | $C_1$ |
| 2 | $P_{12}$ | $P_{22}$ | ------ | $P_{m2}$ | $C_2$ |
| ⋮ | ⋮ | ⋮ | | ⋮ | ⋮ |
| n | $P_{1n}$ | $P_{2n}$ | ------ | $P_{mn}$ | $C_n$ |

Fig. 17A

| j \ i | 1 | 2 | ------ | m |
|---|---|---|---|---|
| 1 | $P_{11}$ | $P_{21}$ | ------ | $P_{m1}$ |
| 2 | $P_{12}$ | $P_{22}$ | ------ | $P_{m2}$ |
| ⋮ | ⋮ | ⋮ | | ⋮ |
| n | $P_{1n}$ | $P_{2n}$ | ------ | $P_{mn}$ |

*Fig. 17B*

| $f_1$ | |
|---|---|
| j′ | j |
| 1 | 1 |
| n | 2 |
| 3 | 3 |
| n−2 | 4 |
| ⋮ | ⋮ |
| n−1 | n−1 |
| 2 | n |

n : even number

*Fig. 17C*

| $f_1$ | |
|---|---|
| j′ | j |
| n | 1 |
| 1 | 2 |
| n−2 | 3 |
| 3 | 4 |
| ⋮ | ⋮ |
| 2 | n−1 |
| n−1 | n |

n : even number

*Fig. 17D*

| $f_1$ | |
|---|---|
| j′ | j |
| 2 | 1 |
| n−1 | 2 |
| 4 | 3 |
| n−3 | 4 |
| ⋮ | ⋮ |
| n | n−1 |
| 1 | n |

n : even number

*Fig. 17E*

| $f_1$ | |
|---|---|
| j′ | j |
| n−1 | 1 |
| 2 | 2 |
| n−3 | 3 |
| 4 | 4 |
| ⋮ | ⋮ |
| 1 | n−1 |
| n | n |

n : even number

*Fig. 17F*

| $f_1$ | |
|---|---|
| j′ | j |
| 1 | 1 |
| n−1 | 2 |
| 3 | 3 |
| n−3 | 4 |
| ⋮ | ⋮ |
| 2 | n−1 |
| n | n |

n : odd number

Fig. 25A

| j \ i | 1 | 2 | ------ | m |
|---|---|---|---|---|
| 1 | $P_{11}$ | $P_{21}$ | ------ | $P_{m1}$ |
| 2 | $P_{12}$ | $P_{22}$ | ------ | $P_{m2}$ |
| ⋮ | ⋮ | ⋮ | | ⋮ |
| n | $P_{1n}$ | $P_{2n}$ | ------ | $P_{mn}$ |

Fig. 25B

| $f_1$ | |
|---|---|
| j' | j |
| 1 | 1 |
| n | 2 |
| 3 | 3 |
| n−2 | 4 |
| ⋮ | ⋮ |
| n−1 | n−1 |
| 2 | n |

n : even number

Fig. 25C

| $f_2$ | |
|---|---|
| j' | j |
| n | 1 |
| 1 | 2 |
| n−2 | 3 |
| 3 | 4 |
| ⋮ | ⋮ |
| 2 | n−1 |
| n−1 | n |

n : even number

FIELD SEQUENTIAL DRIVING TYPE LIQUID CRYSTAL DISPLAY APPARATUS CAPABLE OF INCREASING BRIGHTNESS WHILE SUPPRESSING IRREGULARITY, AND ITS DRIVING METHOD

BACKGROUND OF THE INVENTION

1. Field of the Invention

The present invention relates to a liquid crystal display (LCD) apparatus and its driving method, and more particularly, to a field sequential driving type full-color LCD apparatus and its driving method.

2. Description of the Related Art

Field sequential driving type LCD apparatuses have been developed where three color signals, i.e., a red signal, a green signal and a blue signal are time-divisionally displayed. In such field sequential driving type LCD apparatuses, since three color filters are unnecessary and pixels are in common for the red signal, the green signal and the blue signal, a higher numerical aperture can be realized, so that the utilization of optical sources is higher which would further decrease the power consumption. Therefore, field sequential driving type LCD apparatuses have been used in mobile apparatuses such as mobile telephones or personal digital assistants (PDAs).

In a prior art field sequential driving type LCD apparatus, a black signal is written into all the pixels before a color signal for one sub-frame is written into the pixels. Then, rows of the pixels are sequentially selected so that video signal levels are written thereinto. Finally, when the change of the transmittivities of the rows of the pixels is very small, a respective backlight is turned ON for a predetermined time period. This will be explained later in detail.

In the above-described prior art field sequential driving type LCD apparatus, however, in order to increase the brightness, if the predetermined time period where the back light is being turned ON is increased, large differences are generated among the transmittivities of the rows, so that the brightness is irregular.

SUMMARY OF THE INVENTION

It is an object of the present invention to provide a field sequential driving type LCD apparatus capable of increasing the brightness while suppressing the irregularity thereof and its driving method.

Another object is to provide a field sequential driving type LCD apparatus capable of suppressing the flicker thereof and its driving method.

According to the present invention, in a sequential driving method for time-divisionally displaying a plurality of color signals in respective ones of sub-frames forming one frame in an LCD apparatus including a plurality of data lines, a plurality of gate lines, and a plurality of liquid crystal pixels each including a liquid crystal cell and a switching element, black signals are written into all of the liquid crystal pixels at a beginning period of each of the sub-frames. Then, one of the color signals is sequentially written into rows of the liquid crystal pixels while the gate lines are sequentially selected. Finally, a respective one of a plurality of backlights each corresponding to one of the color signals is turned ON at an end period of each of the sub-frames. In this case, a level of pixel components of the one of the color signals to be written into one of the rows of the liquid crystal pixels is compensated for, so that a change of an average transmittivity of each of the rows of the liquid crystal pixels is sufficiently small before the end period.

In another aspect of the present invention, in the above-mentioned LCD apparatus, if n is a number of the gate lines and is an even number, the 1st, the n-th, the 3rd, the (n−2)-th, . . . , the (n−1)-th and the 2nd gate lines are sequentially selected. Or, the n-th, the 1st, the (n−2)-th, the 3rd, . . . , the 2nd and the (n−1)-th gate lines are sequentially selected. Or, the 2nd, the (n−1)-th, the 4-th, the (n−3)-th, . . . , the n-th and the 1st gate lines are sequentially selected. Or, the (n−1)th, the 2nd, the (n−3)-th, the 4-th, . . . , the 1st, and the n-th gate lines are sequentially selected. On the other hand, if n is a number of the gate lines and is an odd number, the 1st, the (n−1)-th, the 3rd, the (n−3)-th, . . . , the 2nd and the n-th gate lines are sequentially selected.

Further, in a still other aspect of the present invention, if n is an even number, the 1st, the n-th, the 3rd, the (n−2)-th, . . . , the (n−1)-th and the 2nd gate lines are sequentially selected for a first one of the sub-frames, and the n-th, the 1st, the (n−2)-th, the 3rd, . . . , the 2nd, the (n−1)-th are sequentially selected for a second one of the sub-frames next to the first sub-frame. Otherwise, the 2nd, the (n−1)-th, the 4-th, the (n−3)-th, . . . , the n-th and the 1st gate lines are sequentially selected for a first one of the sub-frames, and the (n−1)-th, the 2nd, the (n−3)-th, the 4-th, . . . , the 1st, the n-th are sequentially selected for a second one of the sub-frames next to the first sub-frame.

BRIEF DESCRIPTION OF THE DRAWINGS

The present invention will be more clearly understood from the description set forth below, as compared with the prior art, with reference to the accompanying drawings, wherein:

FIG. 7 is a block circuit diagram illustrating a first embodiment of the field sequential driving type LCD apparatus according to the present invention;

FIG. 17A is a table showing pixel data of one sub-frame of the LCD apparatus of FIG. 12;

FIG. 17B is a table showing a transformation function of j in the flowchart of FIG. 16;

FIGS. 17C, 17D, 17E and 17F are tables showing modifications of FIG. 17B;

FIG. 25A is a table showing pixel data of one sub-frame of the LCD apparatus of FIG. 19;

FIGS. 25B and 25C are tables showing transformation functions of j in the flowchart of FIG. 24.

DESCRIPTION OF THE PREFERRED EMBODIMENTS

Before the description of the preferred embodiments, a prior art LCD apparatus will be explained with reference to FIGS. 1, 2, 3, 4, 5 and 6.

Figure 1:
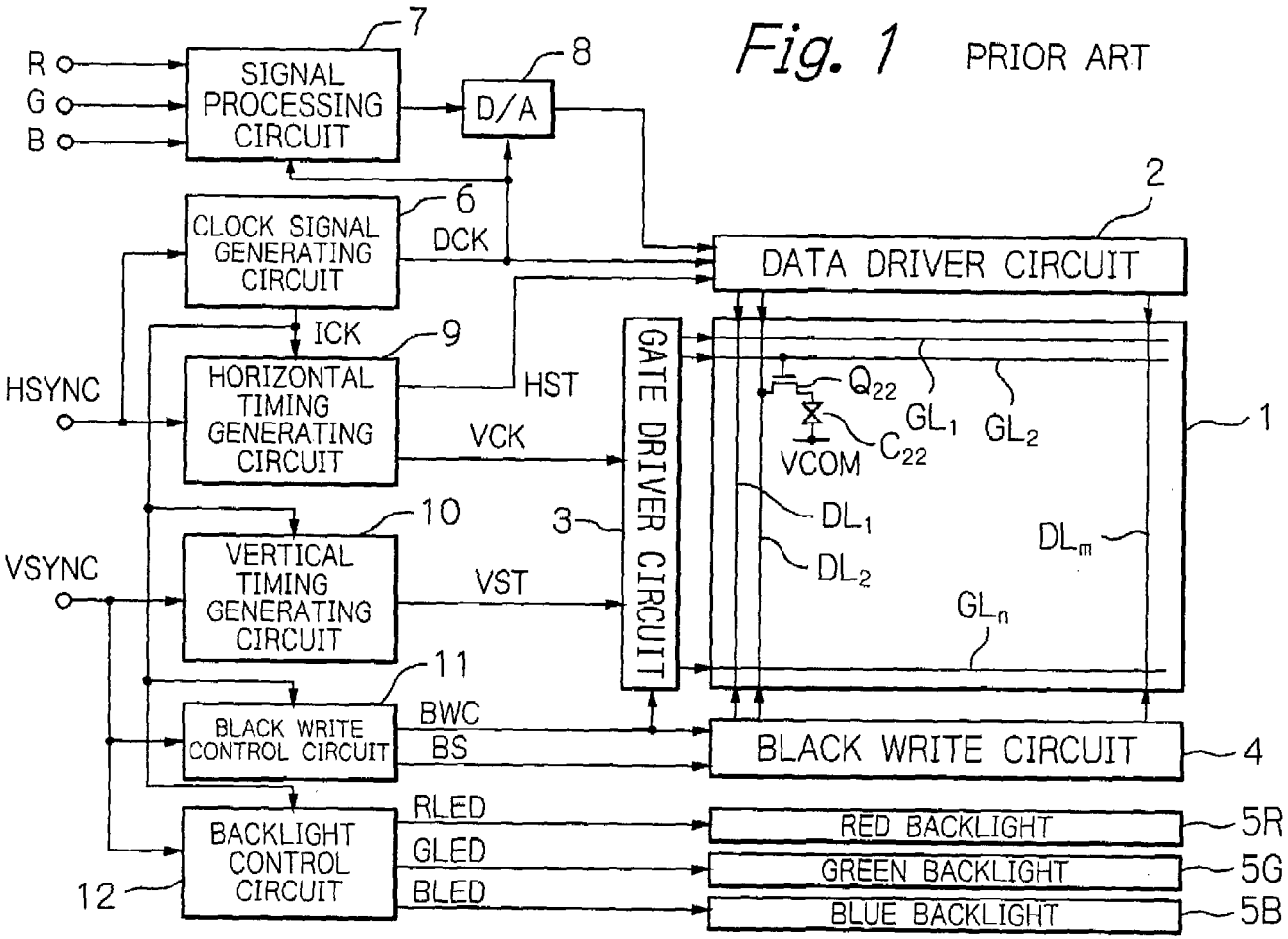
Fig. 1 PRIOR ART
FIG. 1 is a block circuit diagram illustrating a prior art field sequential driving type LCD apparatus.

In FIG. 1, which illustrates a prior art LCD apparatus, reference numeral 1 designates an LCD panel having m×n dots. That is, the LCD panel 1 includes data lines $DL_1$, $DL_2$, . . . , $DL_m$ driven by a data driver circuit 2, gate lines $GL_1$, $GL_2$, . . . , $GL_n$ driven by a gate driver circuit 3, and pixels each connected to one of the data lines $DL_1$, $DL_2$, . . . , $DL_m$ and one of the gate lines $GL_1$, $GL_2$, . . . , $GL_n$. Each of the pixels is formed by a thin film transistor (TFT)$Q_{ij}$ and a liquid crystal cell $C_{ij}$ where i=1, 2, . . . , m and j=1, 2, . . . , n. Also, the data lines $DL_1$, $DL_2$, . . . , $DL_m$ are connected to a black write circuit 4 for writing a black signal into all the pixels. Further, a red backlight 5R formed by red light emitting diodes, a green backlight 5G formed by green light emitting diodes and a blue backlight 5B formed by blue light emitting diodes are provided on the back of the LCD panel 1.

A horizontal synchronization signal HSYNC is supplied to a clock signal generating circuit 6 for generating a data clock signal DCK and an internal clock signal ICK. The clock signal generating circuit 6 is constructed by a phase-lock loop including a voltage oscillating controller (VCO), frequency dividers and the like.

A signal processing circuit 7 including video memories receives color signals R, G and B of a digital video signal and sequentially transmits the color signals R, G and B to a digital/analog (D/A) converter 8 in synchronization with the dot clock signal DCK. As a result, analog color signals R, G and B are supplied to the data driver circuit 2.

Also, the horizontal synchronization signal HSYNC is fetched by a horizontal timing generating circuit 9 in synchronization with the clock signal ICK, so that a horizontal start signal HST and a vertical clock signal VCK are generated in accordance with the horizontal synchronization signal HSYNC. The horizontal start signal HST is supplied to the data driver circuit 2, while the vertical clock signal VCK is supplied to the gate driver circuit 3.

Further, a vertical synchronization signal VSYNC is fetched by a vertical timing generating circuit 10 in synchronization with the clock signal ICK, so that a vertical start signal VST is generated in accordance with the vertical synchronization signal VSYNC. In this case, three vertical start signals VST are generated for each vertical synchronization signal VSYNC. The vertical start signal VST is supplied to the gate driver circuit 3.

The vertical synchronization signal VSYNC as well as the clock signal ICK is also supplied to a black write control circuit 11 which generates a black write control signal BWC and a black level power supply voltage BS in accordance with the color signals R, G and B. The black write control signal BWC is supplied to the gate driver circuit 3 and the black write circuit 4, while the black level power supply voltage BS is supplied to the black write circuit 4.

The vertical synchronization signal VSYNC as well as the clock signal ICK is further supplied to a backlight control circuit 12 which generates a red backlight signal RLED, a green backlight signal GLED and a blue backlight signal BLED in accordance with the color signals R, G and B. The backlight signal RLED, GLED and BLED are supplied to the red backlight 5R, the green backlight 5G and the blue backlight 5B, respectively.

Figure 2:
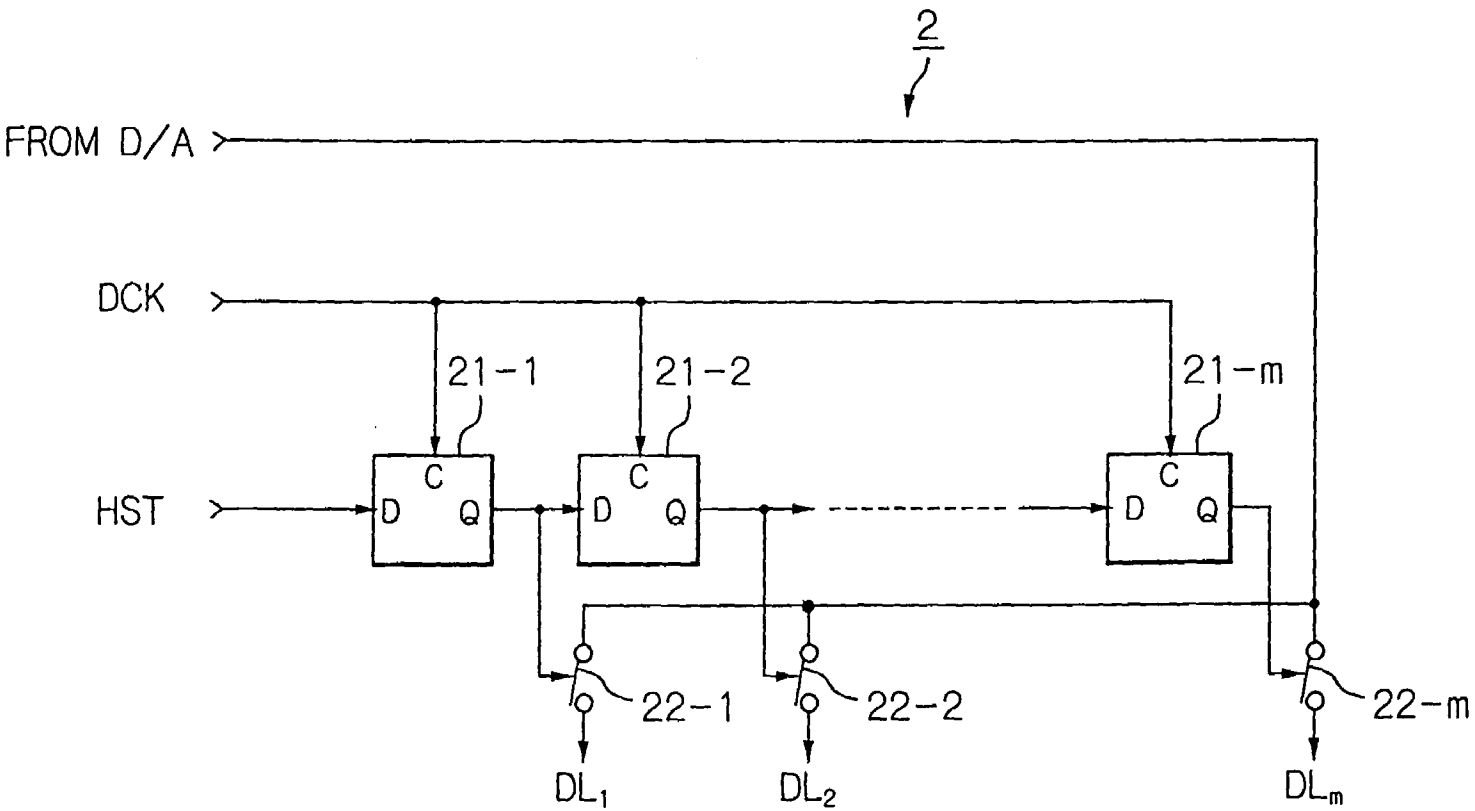
Fig. 2 PRIOR ART
FIG. 2 is a detailed circuit diagram of the data driver circuit of FIG. 1.

In FIG. 2, which is a detailed circuit diagram of the data driver circuit 2 of FIG. 1, shift registers formed by D-type flip-flops 21-1, 21-2, . . . , 21-m are serially-connected, so that the horizontal start signal HST is shifted through the shift registers 21-1, 21-2, . . . , 21-m by the data clock signal DCK. The output signals of the shift registers 21-1, 21-2, . . . , 21-m control switching circuits 22-1, 22-2, . . . , 22-m, respectively, which receive the data signal of the D/A converter 8. Thus, the switching circuits 22-1, 22-2, . . . , 22-m sequentially drive the data lines $DL_1$, $DL_2$, . . . , $DL_m$, in accordance with the dots of the color signals R, G and B.

Figure 3:
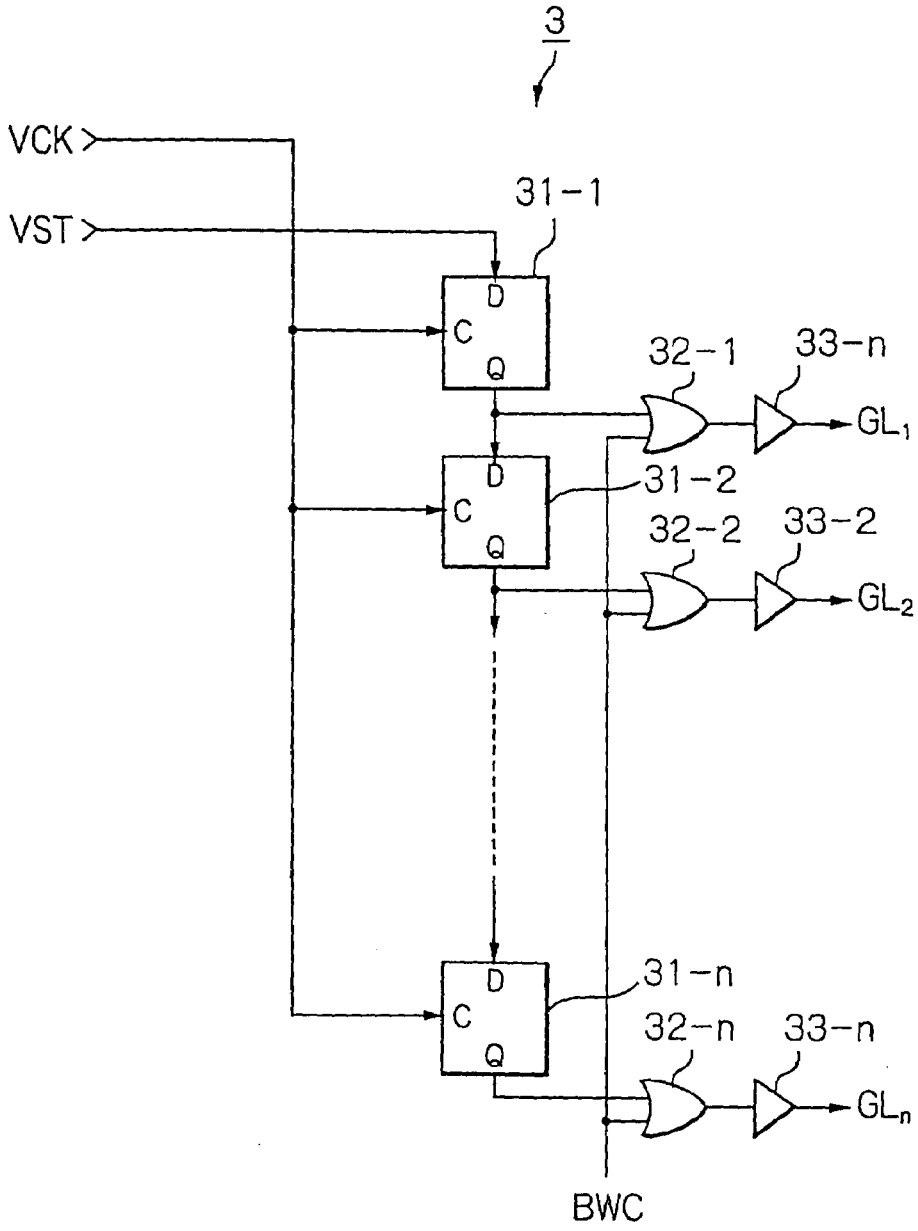
Fig. 3 PRIOR ART
FIG. 3 is a detailed circuit diagram of the gate driver circuit of FIG. 1.

In FIG. 3, which is a detailed circuit diagram of the gate driver circuit 3 of FIG. 1, shift registers (D-type flip-flops) 31-1, 31-2, . . . , 31-n are serially-connected, so that the vertical start signal VST is shifted through the shift registers 31-1, 31-2, . . . , 31-n by the vertical clock signal VCK. The output signals of the shift registers 31-1, 31-2, . . . , 31-n are supplied via OR circuits 32-1, 32-2, . . . , 32-n and buffers 33-1, 33-2, . . . , 33-n to the gate lines $GL_1$, $GL_2$, . . . , $GL_n$. In this case, the OR circuits 32-1, 32-2, . . . , 32-n receive the black write control signal BWC.

When the black write control signal BWC is "0" (low), the buffers 33-1, 33-2, . . . , 33-n sequentially drive the gate lines $GL_1$, $GL_2$, . . . , $GL_n$ in accordance with the vertical clock signal VCK, i.e., the horizontal synchronization signal HSYNC. On the other hand, when the black write control signal BWC is "1" (high), the buffers 33-1, 33-2, . . . , 33-n drive all the gate lines $GL_1$, $GL_2$, . . . , $GL_n$.

Figure 4:
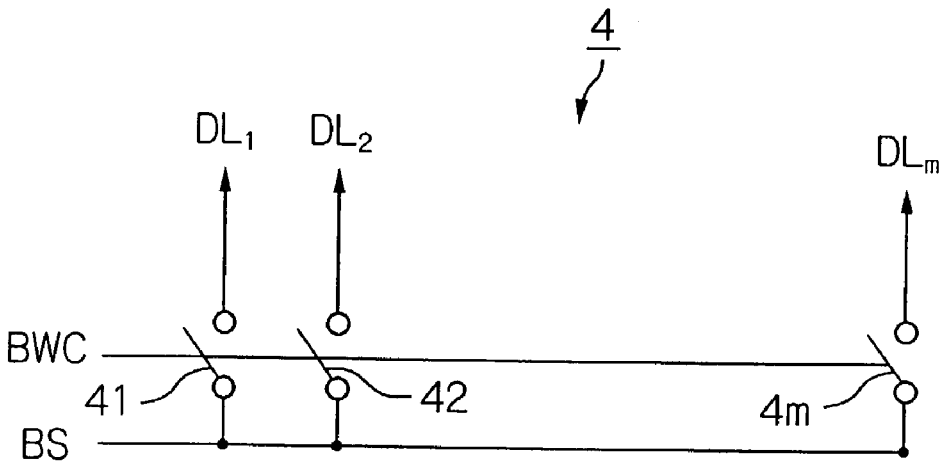
Fig. 4 PRIOR ART
FIG. 4 is a detailed circuit diagram of the black write circuit of FIG. 1.

In FIG. 4, which is a detailed circuit diagram of the black write circuit 4 of FIG. 1, switching circuits 41, 42, . . . , 4*m* for receiving the black level power supply voltage BS are connected to the data lines $DL_1$, $DL_2$, . . . , $DL_m$, respectively, and are controlled by the black write control signal BWC. Therefore, when the black write control signal BWC is "1" (high), all the data lines $DL_1$, $DL_2$, . . . , $DL_m$ are caused to be BS.

The operation of the LCD apparatus of FIG. 1 will be explained next with reference to FIG. 5. That is, a field sequential operation is carried out, so that one frame $T_f$ for displaying one full-color picture is divided into three fields, i.e., three sub-frames $T_{sr}$, $T_{sg}$ and $T_{sb}$ for displaying the red signal R, the green signal G and the blue signal B, respectively.

First, at time tr1, tg1 or tb1, the black write control signal BWC is made "1" (high) for a time period $T_B$, so that a black signal is written into all the pixels. Then, at time tr2, tg2 or tb2, video signals of every row are sequentially written into the pixels in accordance with the voltages of the gate lines $GL_1$, $GL_2$, . . . , $GL_n$. Finally, at time tr3, tg3 or tb3, a respective one of the backlights 5R, 5G and 5B is turned ON.

Figure 5:
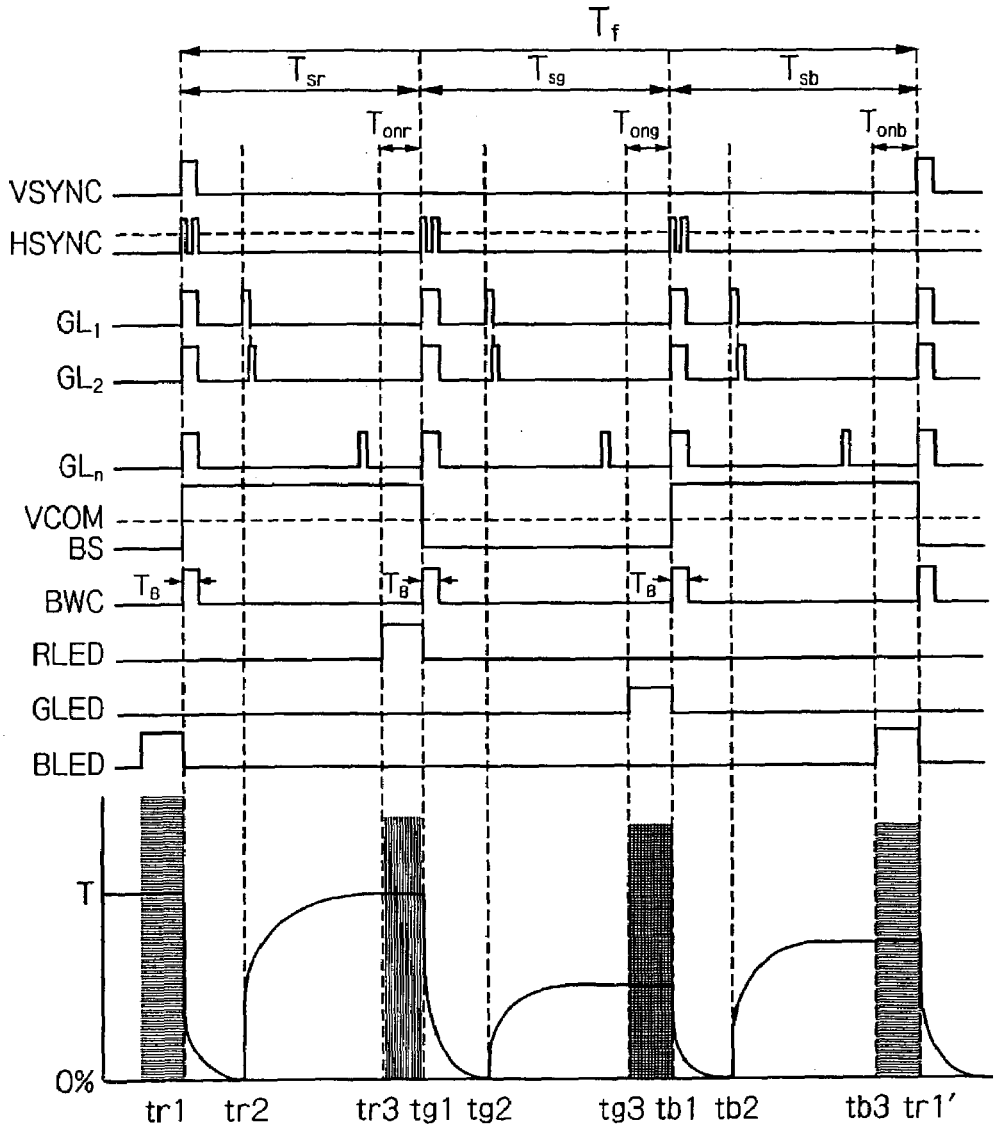
Fig. 5 PRIOR ART
FIG. 5 is a timing diagram for explaining the operation of the LCD apparatus of FIG. 1.

In FIG. 5, since a time required for changing the orientation of liquid crystal molecules is relatively long with respect to the sub-frames $T_{sr}$, $T_{sg}$ and $T_{sb}$, if a green signal G is displayed immediately after a red signal R is displayed, the hysteresis of the red signal remains in the displayed green signal G, which is called a color mixture phenomenon. In order to avoid this color mixture phenomenon, before displaying each color signal, the above-mentioned black write control operation is carried out to completely erase the previously-displayed color signal as shown in FIG. 5 where the transmittivity T of the LCD panel 1 is completely decreased to 0% at time tr2, tg2 or tb2.

Figure 6:
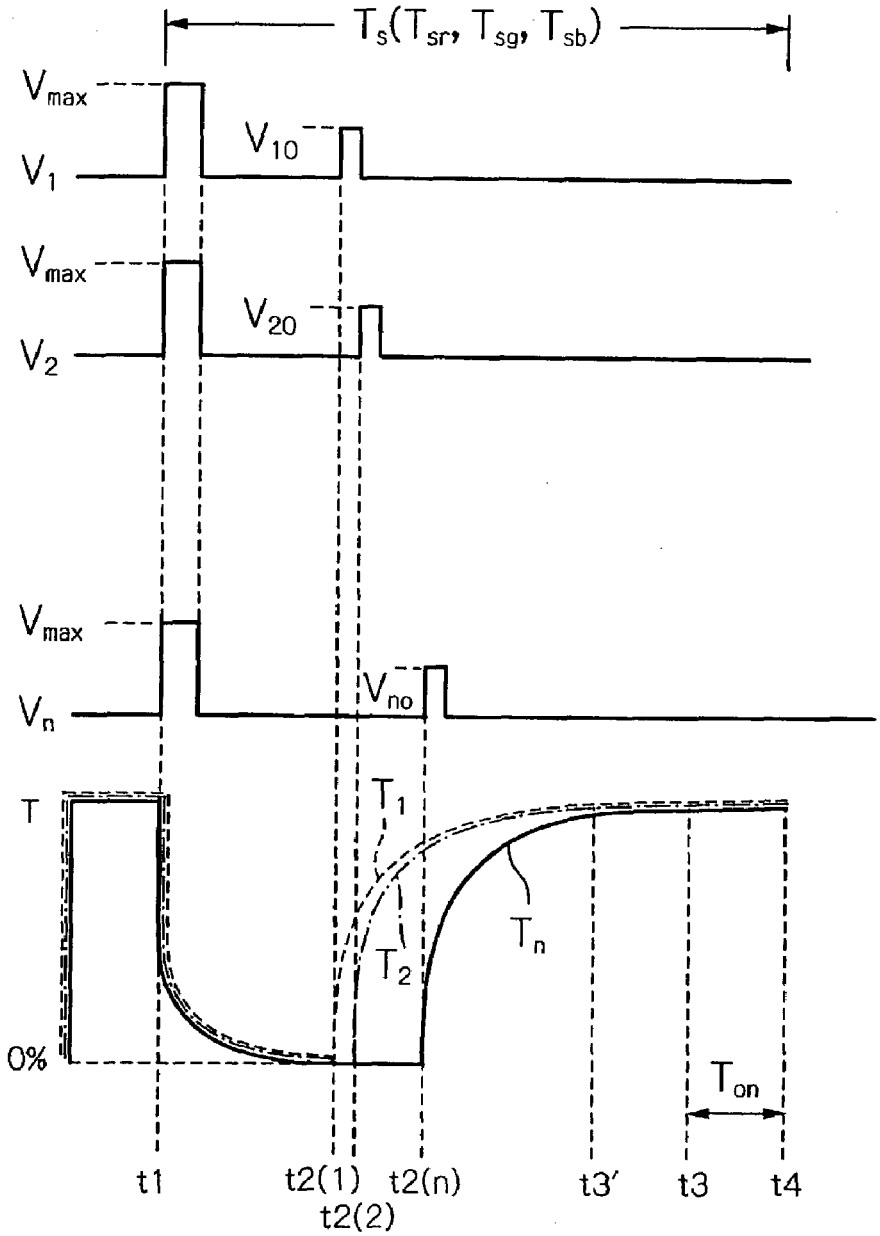
Fig. 6 PRIOR ART
FIG. 6 is a timing diagram for showing the transmittivities of the LCD apparatus of FIG. 1.

In FIG. 6, which is a timing diagram for showing the transmittivities T of the LCD apparatus of FIG. 1, $T_s$ designates one of the sub-frames $T_{sr}$, $T_{sg}$ and $T_{sb}$, $V_1$, $V_2$, . . . , $V_n$ designate average video signal levels of a first row, a second row, . . . , an n-th row, respectively, of the pixels, and $T_1$, $T_2$, . . . , $T_n$ designate transmittivities of the first row, the second row, . . . , the n-th row, respectively, of the pixels.

First, at time t1, the black level power supply voltage BS is supplied to all the data lines $DL_1$, $DL_2$, . . . , $DL_m$, so that the average video signal levels $V_1$, $V_2$, . . . , $V_n$ are caused to be a maximum value $V_{max}$. As a result, the transmittivities $T_1$, $T_2$, . . . , $T_n$ are rapidly decreased.

Next, at time t2(1), t2(2), . . . or t2 (n), the j-th (j=1, 2, . . . , n) row of the pixels is selected so that the average video signal level $V_j$ is caused to be $V_{jo}$. As a result, as the orientations of the liquid crystal molecules are changed, the transmittivities $T_1$, $T_2$, . . . , $T_n$, are sequentially changed.

At time t3, when the change of the transmittivities $T_1$, $T_2$, . . . , $T_n$ is very small, the backlight such as 5R is turned ON for a time period $T_{on}$.

Finally, at time t4, the backlight 5R is turned OFF.

In order to increase the brightness, if the backlight 5R is turned ON at time t3' before time t3, large differences are generated among the average transmittivities $T_1$, $T_2$, . . . , $T_n$, so that the brightness is irregular. Particularly, the brightness on the lower side of the LCD panel 1 is much more irregular.

In FIG. 7, which illustrates a first embodiment of the field sequential driving type LCD apparatus according to the present invention, a signal processing circuit 7A is provided instead of the signal processing circuit 7 of FIG. 1. The signal processing circuit 7A receives the vertical start signal VST.

Figures 8A, 8B:
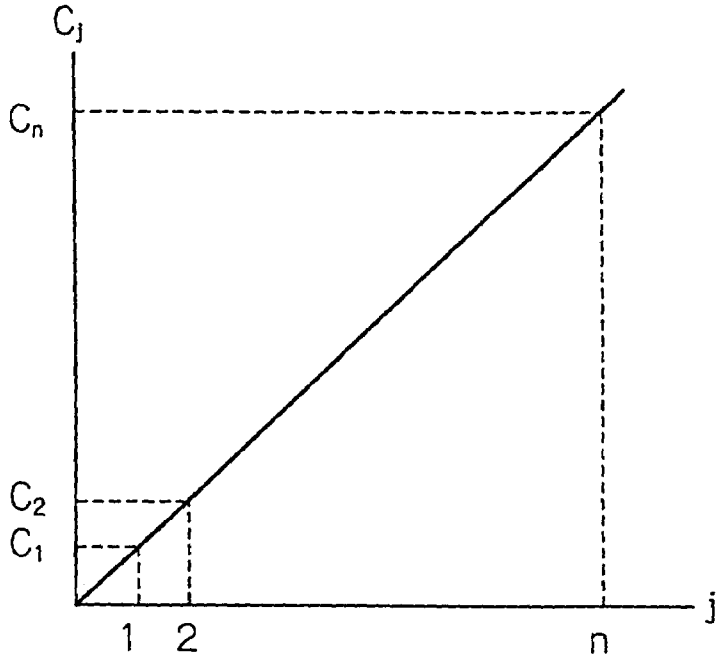
FIG. 8A is a table showing pixel data and compensating coefficients of one sub-frame of the LCD apparatus of FIG. 7.
FIG. 8B is a graph showing an example of the compensating coefficients of FIG. 8A.

The signal processing circuit 7A performs a compensating operation upon pixel data in accordance with the row location thereof. For example, pixel data $P_{ij}$ (i=1, 2, . . . , m; j=1, 2, . . . , n) for one sub-frame is represented as shown in FIG. 8A. In this case, a compensating coefficient $C_j$ (j=1, 2, . . . , n) is predetermined as shown in FIG. 8B. That is, the compensating coefficient $C_2$ at the second row is larger than the compensating coefficient $C_1$ at the first row, the compensating coefficient $C_3$ at the third row is larger than the compensating coefficient $C_2$ at the second row, and so on. That is, $$C_1<C_2< \ldots <C_n$$

In FIG. 8B, note that the compensating coefficient $C_j$ is linearly-changed with respect to the row location j; however, the relationship between the compensating coefficient $C_j$ and the row location j can be determined by the simulating of transmittivity characteristics. In this case, $$C_1 \leqq C_2 \leqq \ldots \leqq C_n$$

Figure 9:
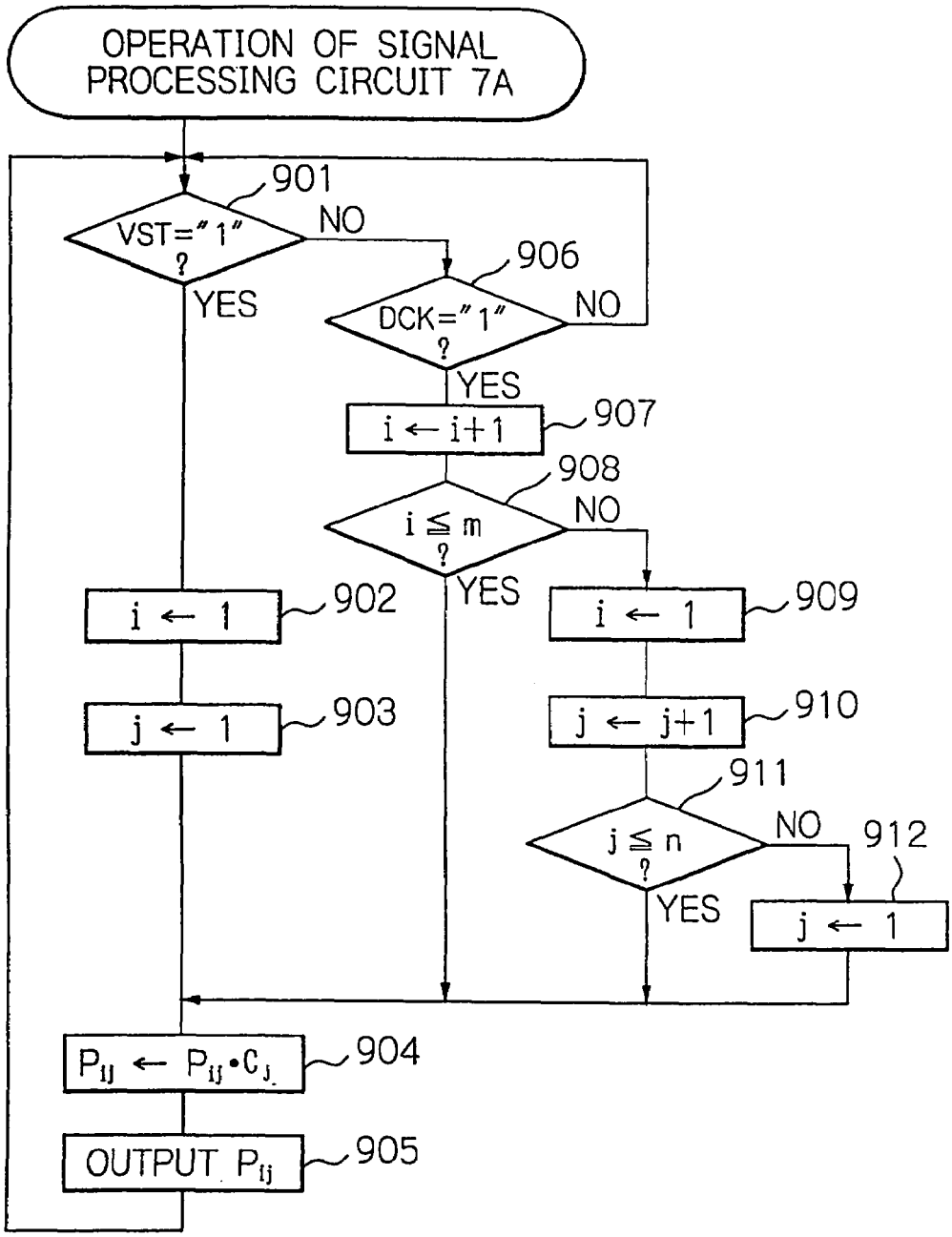
FIG. 9 is a flowchart for explaining the operation of the signal processing circuit of FIG. 7.

The operation of the signal processing circuit 7A will be explained next with reference to FIG. 9.

First, at step 901, it is determined whether or not a vertical start signal VST is received. Only when the vertical start signal VST is received (VST="1"), does the control proceed to steps 902 and 903 where values i and j are initialized at 1. Then, at step 904, pixel data $P_{ij}$ is compensated for by $$P_{ij} \leftarrow P_{ij} \cdot C_j$$

Then, the pixel data $P_{ij}$ is output to the D/A converter 8, and the control returns to step 901.

When it is determined that the vertical start signal VSYNC is not received (VST="0") at step 901, the control proceeds to step 906 which determines whether or not a data clock signal DCK is received. Only when the data clock signal DCK is received (DCK="1"), does the control proceed to step 907. Otherwise, the control returns to step 901.

At step 907, the value i is incremented by 1, and then, at step 908, it is determined whether or not $i \leqq m$ is satisfied. Only when $i \leqq m$, does the control proceed directly to steps 904 and 905 which compensate for $P_{ij}$ and transmit the compensated pixel data $P_{ij}$ to the D/A converter 8. Otherwise, the control proceeds to step 909.

At step 909, the value i is initialized at 1. Then, at step 910, the value j is incremented by 1, and at step 911, it is determined whether or not $j \leqq n$ is satisfied. Only when $j \leqq n$ is satisfied, does control proceed directly to steps 904 and 905 which compensate for $P_{ij}$ and transmit the compensated $P_{ij}$ to the D/A converter 8. Otherwise, the control proceeds to step 912 which initializes the value j at 1.

Figure 10:
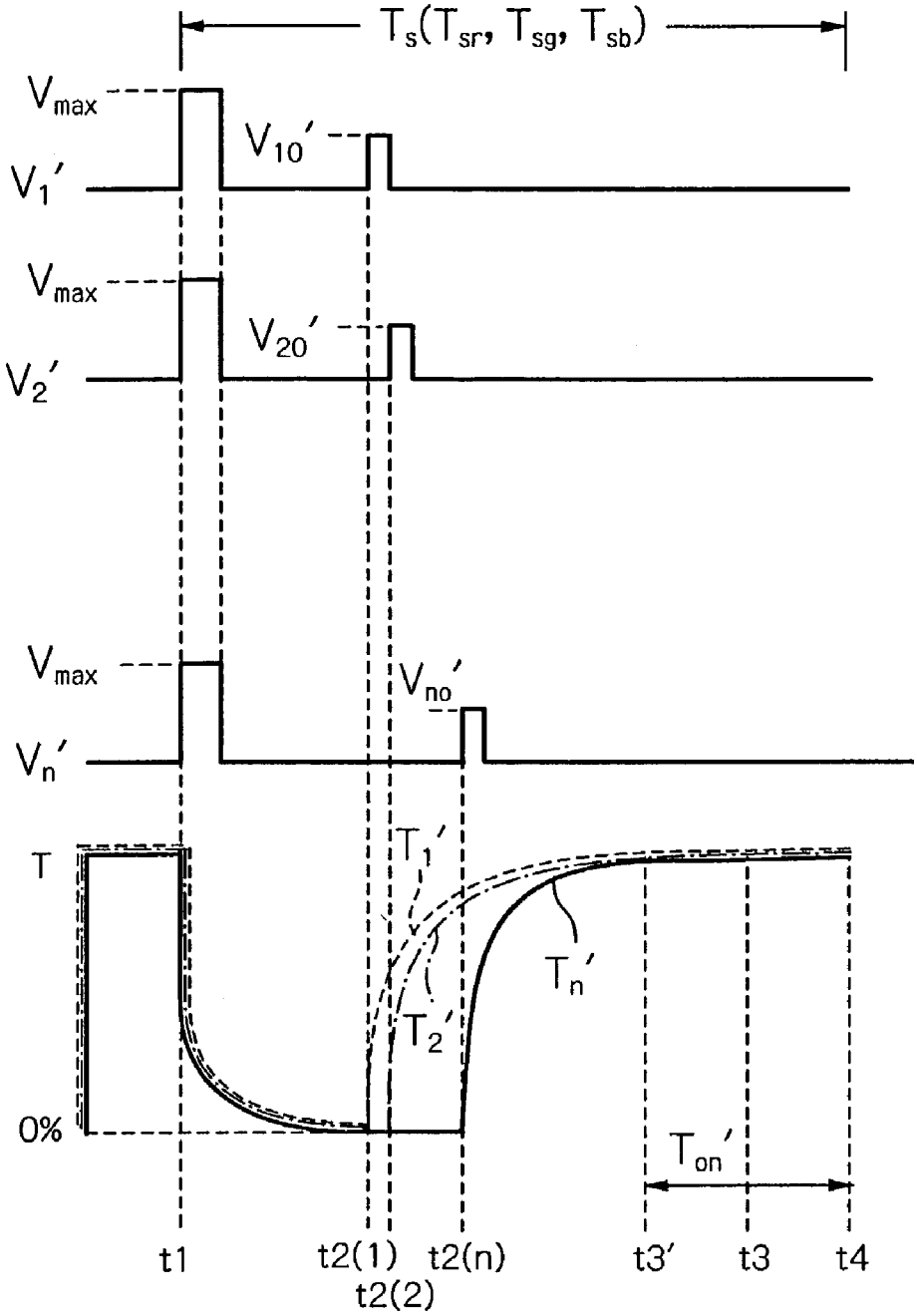
FIG. 10 is a timing diagram for explaining the operation of the LCD apparatus of FIG. 7.

In FIG. 10, which is a timing diagram for showing the transmittivities T of the LCD apparatus of FIG. 7, $T_s$ designates one of the sub-frames $T_{sr}$, $T_{sg}$ and $T_{sb}$, $V_1'$, $V_2'$, . . . , $V_n'$ designate average video signal levels of a first row, a second row, . . . , an n-th row, respectively, of the pixels, and $T_1'$, $T_2'$, . . . , $T_n'$ designate transmittivities of the first row, the second row, . . . , the n-th row, respectively, of the pixels.

First, at time t1, the black level power supply voltage BS is supplied to all the data lines $DL_1$, $DL_2$, . . . , $DL_m$, so that the average video signal levels $V_1'$, $V_2'$, . . . , $V_n'$ are caused to be a maximum value $V_{max}$. As a result, the transmittivities $T_1'$, $T_2'$, . . . , $T_n'$ are rapidly decreased.

Next, at time t2(1), t2(2), . . . or t2 (n), the j-th (i=1, 2, . . . , n) row of the pixels is selected so that the average video signal level $V_j'$ is caused to be $V_{jo}'$. In this case, $V_{20}'$, . . . , $V_{no}'$, are relatively larger than $V_{20}$, . . . , $V_{no}$, respectively, of FIG. 6, since the average video signal $V_j'$ was compensated for. As a result, as the orientations of the liquid crystal molecules are changed, the transmittivities $T_1'$, $T_2'$, . . . , $T_n'$ are sequentially changed. In this case, the transmitivities $T_2'$, . . . , $T_n'$ are relatively-rapidly increased as compared with the transmittivities $T_2$, . . . , $T_n$, respectively of FIG. 6.

At time t3', when the change of the transmittivities $T_1'$, $T_2'$, . . . , $T_n'$ is very small, the backlight such as 5R is turned ON for a time period $T_{on}'$ ($>T_{on}$).

Finally, at time t4, the backlight 5R is turned OFF.

Thus, in the LCD apparatus of FIG. 7, the time period $T_{on}'$ where the backlight is turned ON is made longer, which would increase the brightness.

Figure 11:
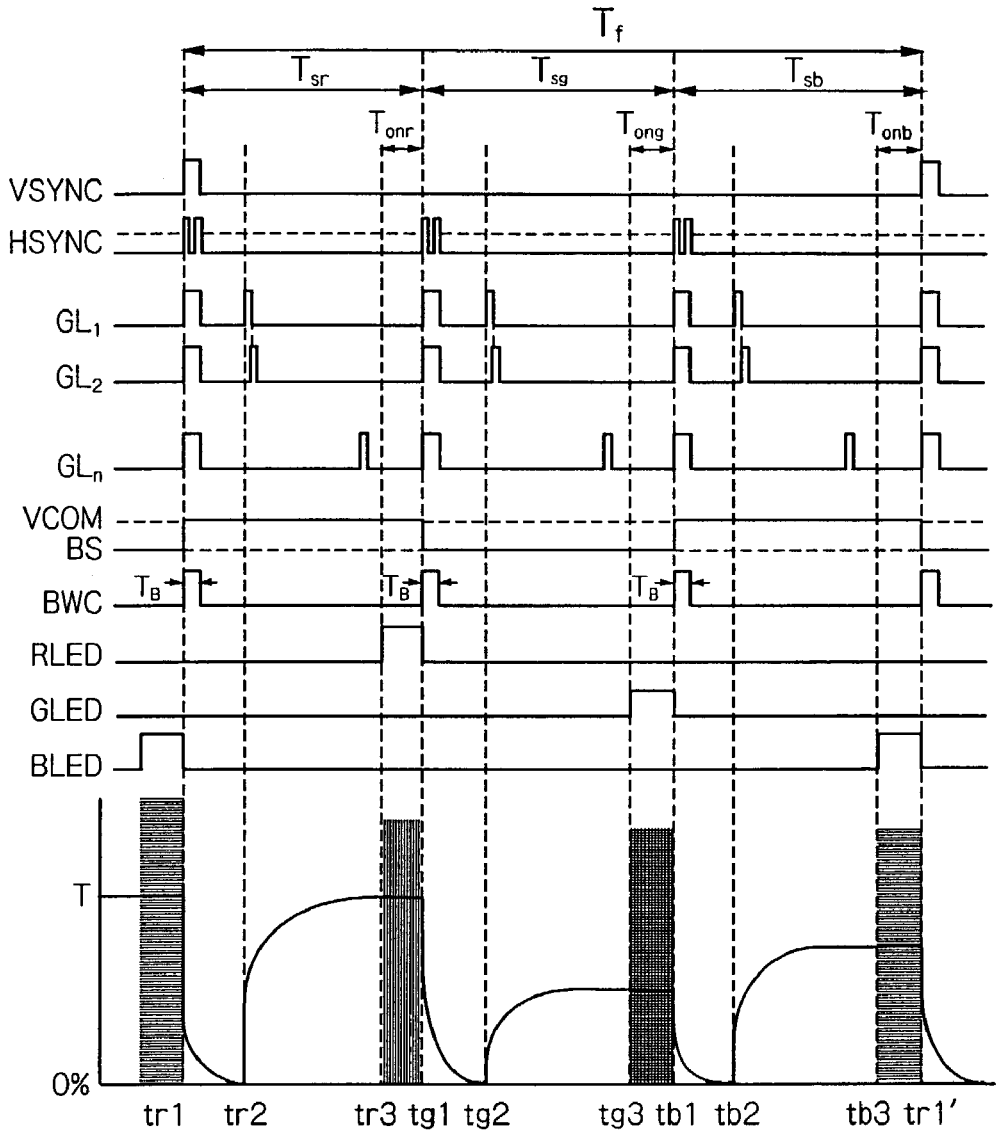
FIG. 11 is a timing diagram for showing the transmittivities of the LCD apparatus of FIG. 7.

In the LCD apparatus of FIG. 7, the operation as illustrated in FIG. 5 is adopted; however, an operation as illustrated in FIG. 11 can be adopted. That is, in FIG. 5, a so-called common symmetrical-driving method is used, i.e., the black level power supply voltage BS is alternately changed symmetrically with the voltage VCOM at the common electrode (counter electrode) for every sub-frame. On the other hand, in FIG. 11, a so-called common inversion driving method is used, i.e., the black level power supply voltage BS and the voltage VCOM at the common electrode (counter electrode) are both changed in opposite directions for every sub-frame. The amplitude of the black level power supply voltage BS in the common inversion driving method is half the amplitude of the black level power voltage in the common symmetrical-driving method.

Figure 12:
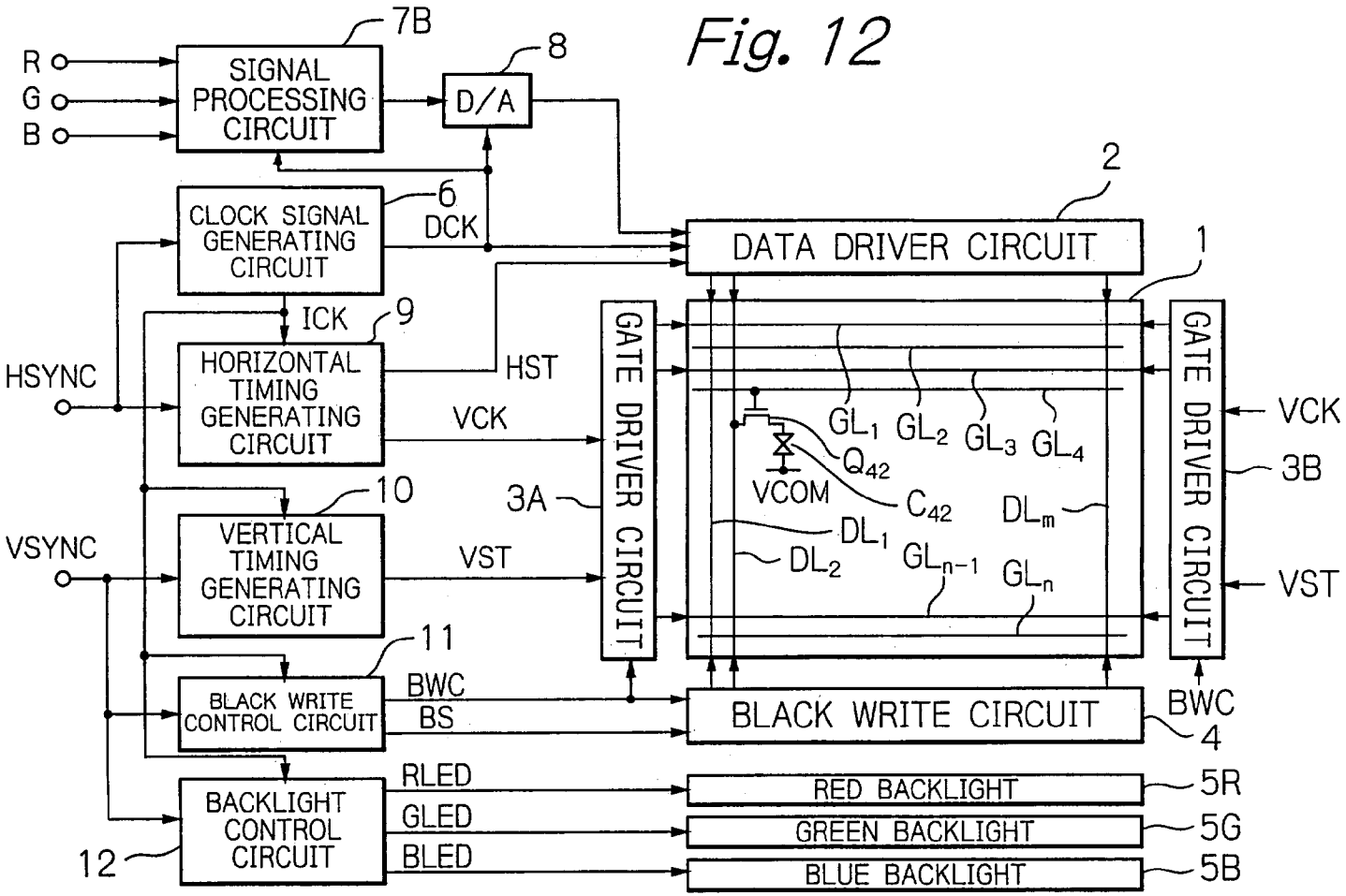
FIG. 12 is a block circuit diagram illustrating a second embodiment of the field sequential driving type LCD apparatus according to the present invention.

In FIG. 12, which illustrates a second embodiment of the field sequential driving type LCD apparatus according to the present invention, the gate driver circuit 3 of FIG. 1 is replaced by two gate driver circuits 3A and 3B, and the signal processing circuit 7 of FIG. 1 is replaced by a signal processing circuit 7B. The gate driver circuit 3A is used for driving the gate lines $GL_1$, $GL_3$, . . . , $GL_{n-1}$, and the gate driver circuit 3B is used for driving the gate lines $GL_2$, $GL_4$, . . . , $GL_n$.

Figure 13:
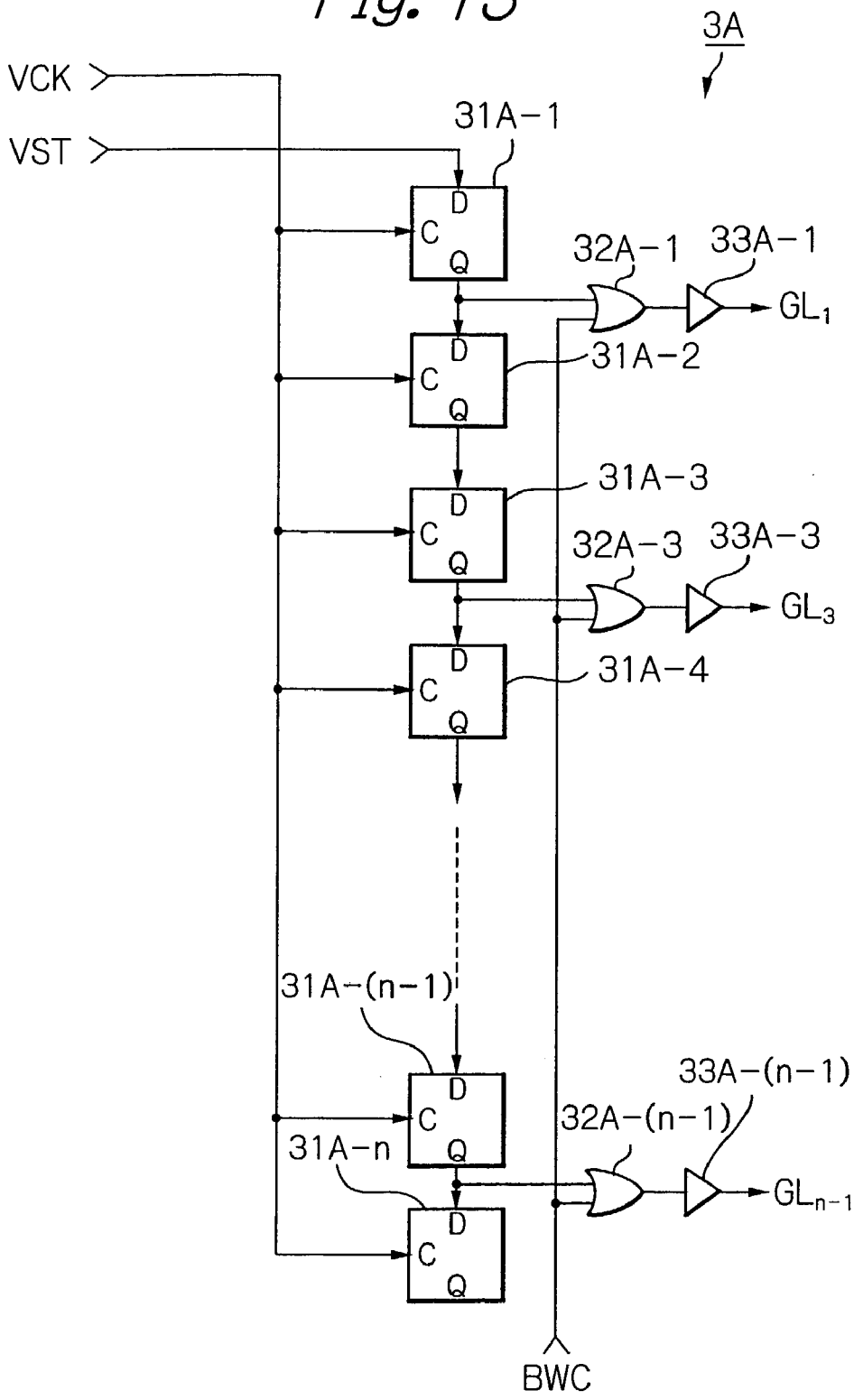
FIG. 13 is a detailed circuit diagram of the data driver circuit of FIG. 12.

In FIG. 13, which is a detailed circuit diagram of the gate driver circuit 3A of FIG. 12, shift registers (D-type flip-flops) 31A-1, 31A-2, 31A-3, 31A-4, . . . , 31A-(n−1), 31A-n are serially-connected, so that the vertical start signal VST is shifted through the shift registers 31A-1, 31A-2, 31A-3, 31A-4, . . . , 31A-(n−1), 31A-n by the vertical clock signal VCK. The output signals of the shift registers 31A-1, 31A-3, . . . , 31A-(n−1) are supplied via OR circuits 32A-1, 32A-3, . . . , 32A-(n−1) and buffers 33A-1, 33A-3, . . . , 33A-(n−1) to the gate lines $GL_1$, $GL_3$, . . . , $GL_{n-1}$. In this case, the OR circuits 32A-1, 32A-3, . . . , 32A-(n−1) receive the black write control signal BWC.

When the black write control signal BWC is "0" (low), the buffers 33A-1, 33A-3, . . . , 33A-(n−1) sequentially drive the gate lines $GL_1$, $GL_3$, . . . , $GL_{n-1}$ in accordance with the vertical clock signal VCK, i.e., the horizontal synchronization signal HSYNC. On the other hand, when the black write control signal BWC is "1" (high), the buffers 33A-1, 33A-3, . . . , 33A-(n−1) drive all the gate lines $GL_1$, $GL_3$, . . . , $GL_{n-1}$.

Figure 14:
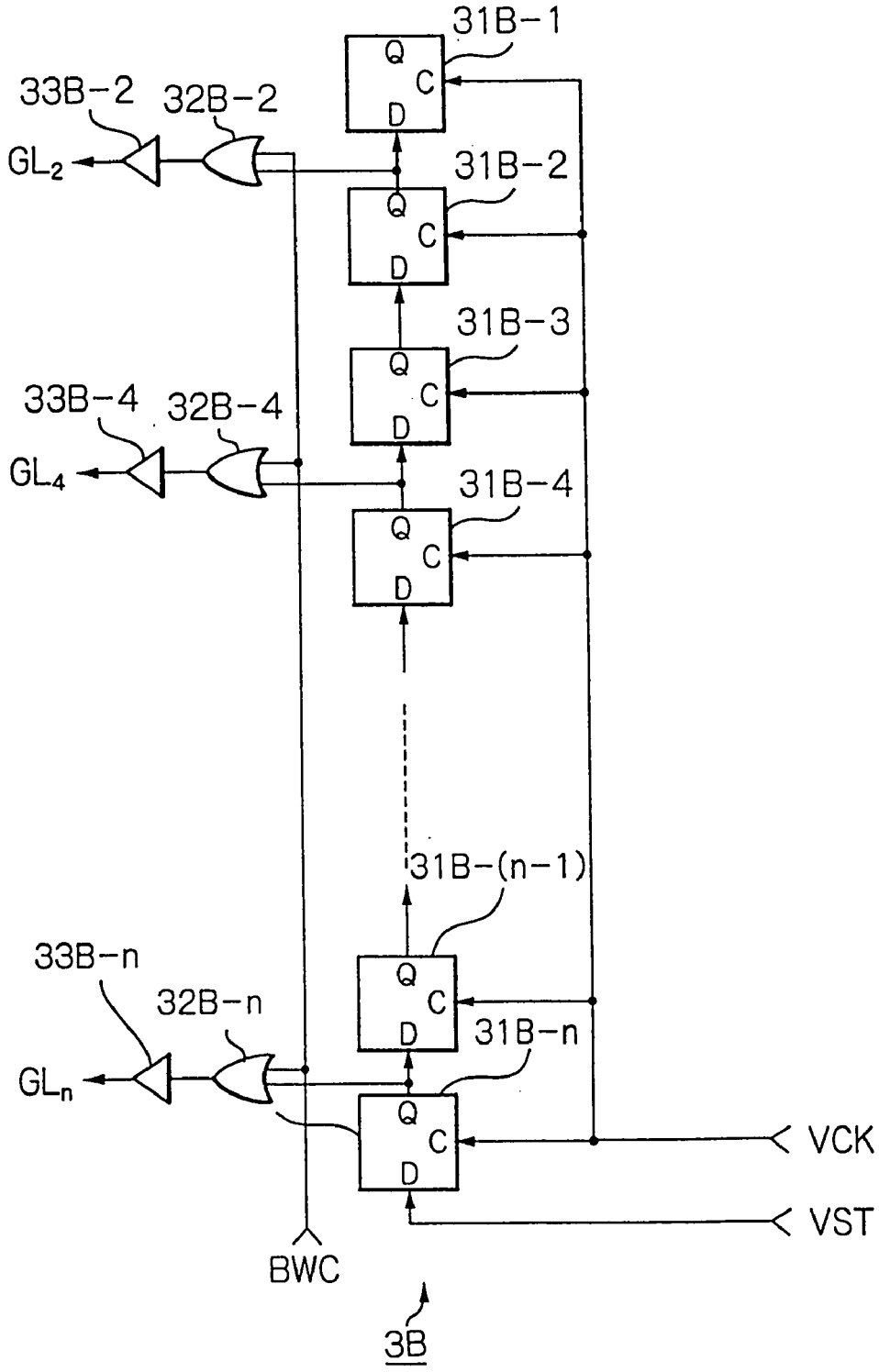
FIG. 14 is a detailed circuit diagram of the gate driver circuit of FIG. 12.

In FIG. 14, which is a detailed circuit diagram of the gate driver circuit 3B of FIG. 12, shift registers (D-type flip-flops) 31B-n, 31B-(n−1), . . . , 31B-4, 31B-3, 31B-2, 31B-1 are serially-connected, so that the vertical start signal VST is shifted through the shift registers 31B-n, 31B-(n−1), . . . , 31B-4, 31B-3, 31B-2, 31B-1 by the vertical clock signal VCK. The output signals of the shift registers 31B-n, . . . , 31B-4, 31B-2 are supplied via OR circuits 32B-n, . . . , 32B-4, 32B-2 and buffers 33B-n, . . . , 33B-4, 33B-2 to the gate lines $GL_n$, . . . , $GL_4$, $GL_2$. In this case, the OR circuits 32B-n, . . . , 32B-4, 32B-2 receive the black write control signal BWC.

When the black write control signal BWC is "0" (low), the buffers 33B-n, . . . , 33B-4, 33B-2 sequentially drive the gate lines $GL_n$, . . . , $GL_4$, $GL_2$ in accordance with the vertical clock signal VCK, i.e., the horizontal synchronization signal HSYNC. On the other hand, when the black write control signal BWC is "1" (high), the buffers 33B-n, . . . , 33B-4, 33B-2 drive all the gate lines $GL_n$, . . . , $GL_4$, $GL_2$.

Figure 15:
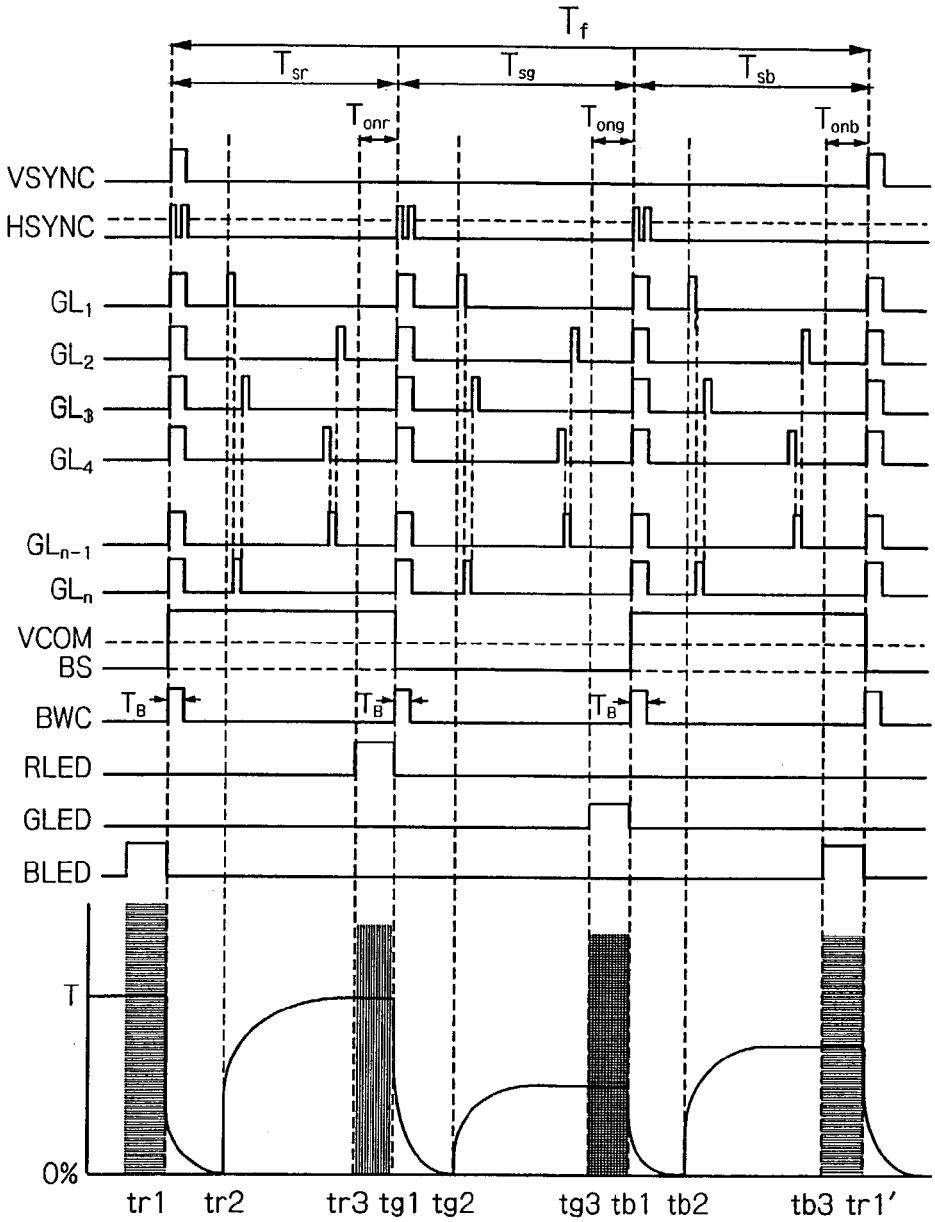
FIG. 15 is a timing diagram for explaining the operation of the LCD apparatus of FIG. 12.

The operation of the LCD apparatus of FIG. 12 will be explained next with reference to FIG. 15. That is, a field sequential operation is carried out, one frame $T_f$ for displaying one full-color picture is divided into three fields, i.e., three sub-frames $T_{sr}$, $T_{sg}$ and $T_{sb}$ for displaying the red signal R, the green signal G and the blue signal B, respectively.

First, at time tr1, tg1 or tb1, the black write control signal BWC is made "1" (high) for a time period $T_B$, so that a black signal is written into all the pixels. Then, at time tr2, tg2 or tb2, video signals of every row are sequentially written into the pixels in accordance with the voltages of the gate lines $GL_1$, $GL_n$, $GL_3$, $GL_{n-2}$, . . . , $GL_4$, $GL_{n-1}$, $GL_2$. Finally at time tr3, tg3 or tb3, a respective one of the backlights 5R, 5G and 5B is turned ON.

The operation of the signal processing circuit 7B will be explained next with reference to FIG. 16 as well as FIGS. 17A and 17B. Note that FIG. 17A is a table showing pixel data for one sub-frame, and FIG. 17B is a table showing a transforming function of j to j'. Also, n is an even number.

First, at step 1601, it is determined whether or not a vertical start signal VST is received. Only when the vertical start signal VST is received (VST="1"), does the control proceed to steps 1602 and 1603 where values i and j are initialized at 1. Then, at step 1604, the value j is converted by a function $f_1$ as shown in FIG. 17B.

$$j' \leftarrow f_1(j)$$

Then, the pixel data $P_{ij}$ is read from the video memories as shown in FIG. 17A and outputted to the D/A converter 8. Then, the control returns to step 1601.

When it is determined what the vertical start signal VSYNC is not received (VST="0") at step 1601, the control proceeds to step 1606 which determines whether or not a data clock signal DCK is received. Only when the data clock signal DCK is received (DCK="1"), does the control proceed to step 1607. Otherwise, the control returns to step 1601.

At step 1607, the value i is incremented by 1, and then, at step 1608, it is determined whether or not $i \leqq m$ is satisfied. Only when $i \leqq m$, does the control proceed directly to steps 1604 and 1605 which transform the value j to j' and transmit the read pixel data $P_{ij}'$ to the D/A converter 8. Otherwise, the control proceeds to step 1609.

At step 1609, the value i is initialized at 1. Then, at step 1610, the value j is incremented by 1, and at step 1611, it is determined whether or not $j \leqq n$ is satisfied. Only when $j \leqq n$ is satisfied, does the control proceed directly to steps 1604 and 1605 which transform the value j to j' and transmit the read pixel data $P_{ij}'$ to the D/A converter 8. Otherwise, the control proceeds to step 1612 which initializes the value j at 1. Then, the control proceeds to steps 1604 and 1605.

Note that the tables of FIG. 17C, 17D or 17E can be used instead of the table of FIG. 17B. Also, if n is an odd number, the table of FIG. 17F is used instead of the table of FIG. 17B.

Figure 18:
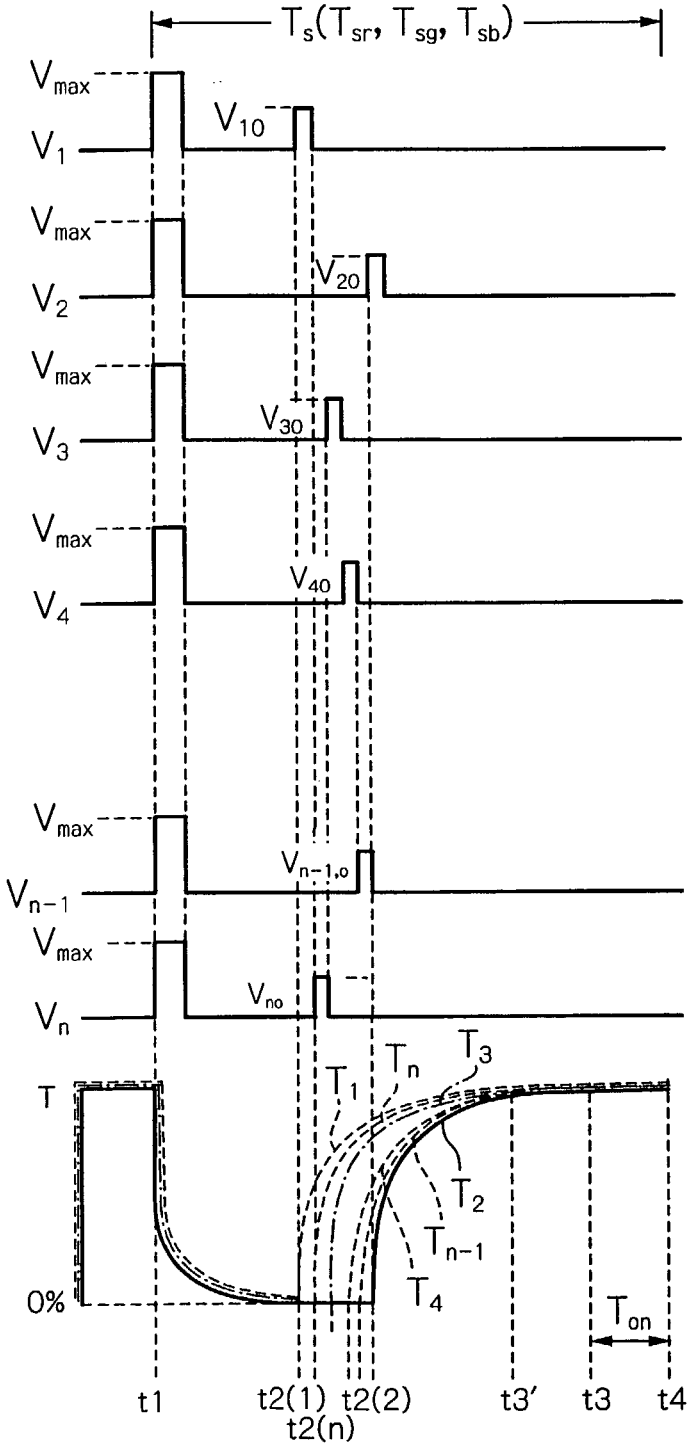
FIG. 18 is a timing diagram for showing the transmittivities of the LCD apparatus of FIG. 12.

In FIG. 18, which is a timing diagram for showing the transmittivities T of the LCD apparatus of FIG. 12, $T_s$ designates one of the sub-frames $T_{sr}$, $T_{sg}$ and $T_{sb}$, $V_1$, $V_2$, $V_3$, $V_4$, . . . , $V_{n+1}$, $V_n$ designate average video signal levels of a first row, a second row, a third row, a fourth row, . . . , an(n−1)-th row, an n-th row, respectively, of the pixels, and $T_1$, $T_2$, $T_3$, $T_4$, . . . , $T_{n-1}$, $T_n$ designate transmittivities of the first row, the second row, the third row, the fourth row, . . . , the (n−1)-th row, the n-th row, respectively, of the pixels.

First, at time t1, the black level power supply voltage BS is supplied to all the data lines $DL_1$, $DL_2$, . . . , $DL_m$, so that the average video signal levels $V_1$, $V_2$, $V_3$, $V_4$, . . . , $V_{n-1}$, $V_n$ are caused to be a maximum value $V_{max}$. As a result, the transmittivities $T_1$, $T_2$, $T_3$, $T_4$, . . . , $T_{n-1}$, $T_n$ are rapidly decreased.

Next, at time t2(1), t2(n), t2(3), . . . , t2(4), t2(n−1), or t2(2), the i-th (i=1, n, 3, . . . , 4, n−1, 2) row of the pixels is selected so that the average video signal level $V_i$ is caused to be $V_{io}$. As a result, as the orientations of the liquid crystal molecules are changed, the transmittivities $T_1$, $T_n$, $T_3$, . . . , $T_4$, $T_{n-1}$, $T_2$ are sequentially changed.

At time t3', the backlight such as 5R is being turned ON for a time period $T_{on}'$ ($>T_{on}$).

Finally, at time t4, the backlight 5R is turned OFF.

In the LCD apparatus of FIG. 12, at time t3' of FIG. 18, although the change of the transmittivities $T_1$, $T_n$, $T_3$, . . . , $T_4$, $T_{n-1}$, $T_2$ is not small, the transmittivities of the two adjacent rows such as $T_1$ and $T_2$, $T_2$ and $T_3$, $T_3$ and $T_4$, . . . , or $T_{n-1}$ and $T_n$ are mixtured due to the proximity of the two adjacent rows. As a result, the change of the transmittivities $T_1$, $T_n$, $T_3$, . . . , $T_4$, $T_{n-1}$, $T_2$ is substantially small at time t3' of FIG. 18.

Thus, even in the LCD apparatus of FIG. 12, the time period $T_{on}'$ where the backlight is turned ON is to made longer, which would increase the brightness.

Figure 19:
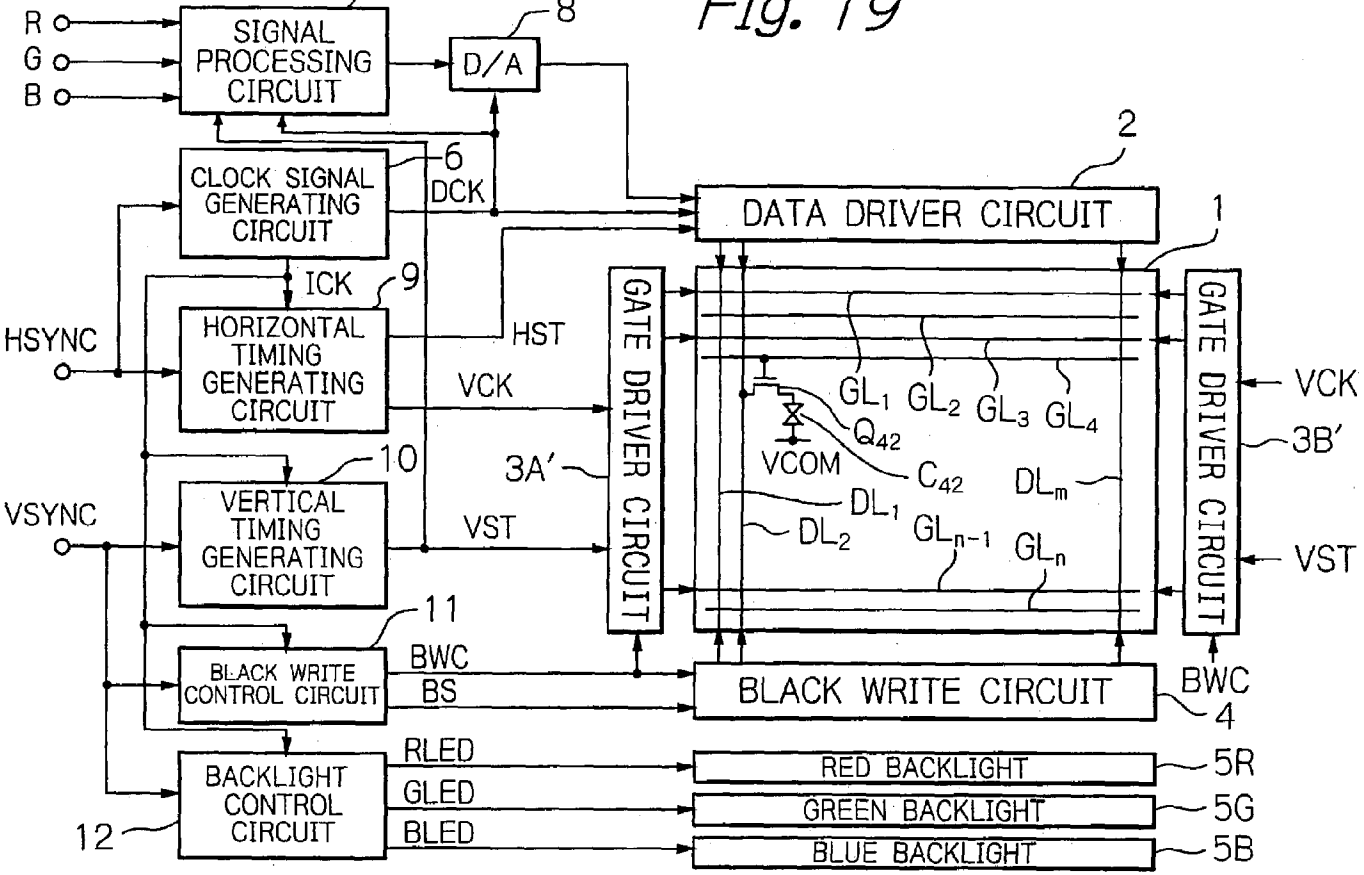
FIG. 19 is a block circuit diagram illustrating a third embodiment of the field sequential driving type LCD apparatus according to the present invention.

In FIG. 19, which illustrates a third embodiment of the field sequential driving type LCD apparatus according to the present invention, the gate driver circuits 3A and 3B of FIG. 12 are replaced by two gate driver circuits 3A' and 3B', respectively, and the signal processing circuit 7B of FIG. 12 is replaced by a signal processing circuit 7C. The gate driver circuit 3A' is used for driving the gate lines $GL_1$, $GL_3$, . . . , $GL_{n-1}$ in an ascending order and in a descending order, and the gate driver circuit 3B is used for driving the gate lines $GL_2$, $GL_4$, . . . , $GL_n$ in a descending order and in an ascending order.

Figure 20:
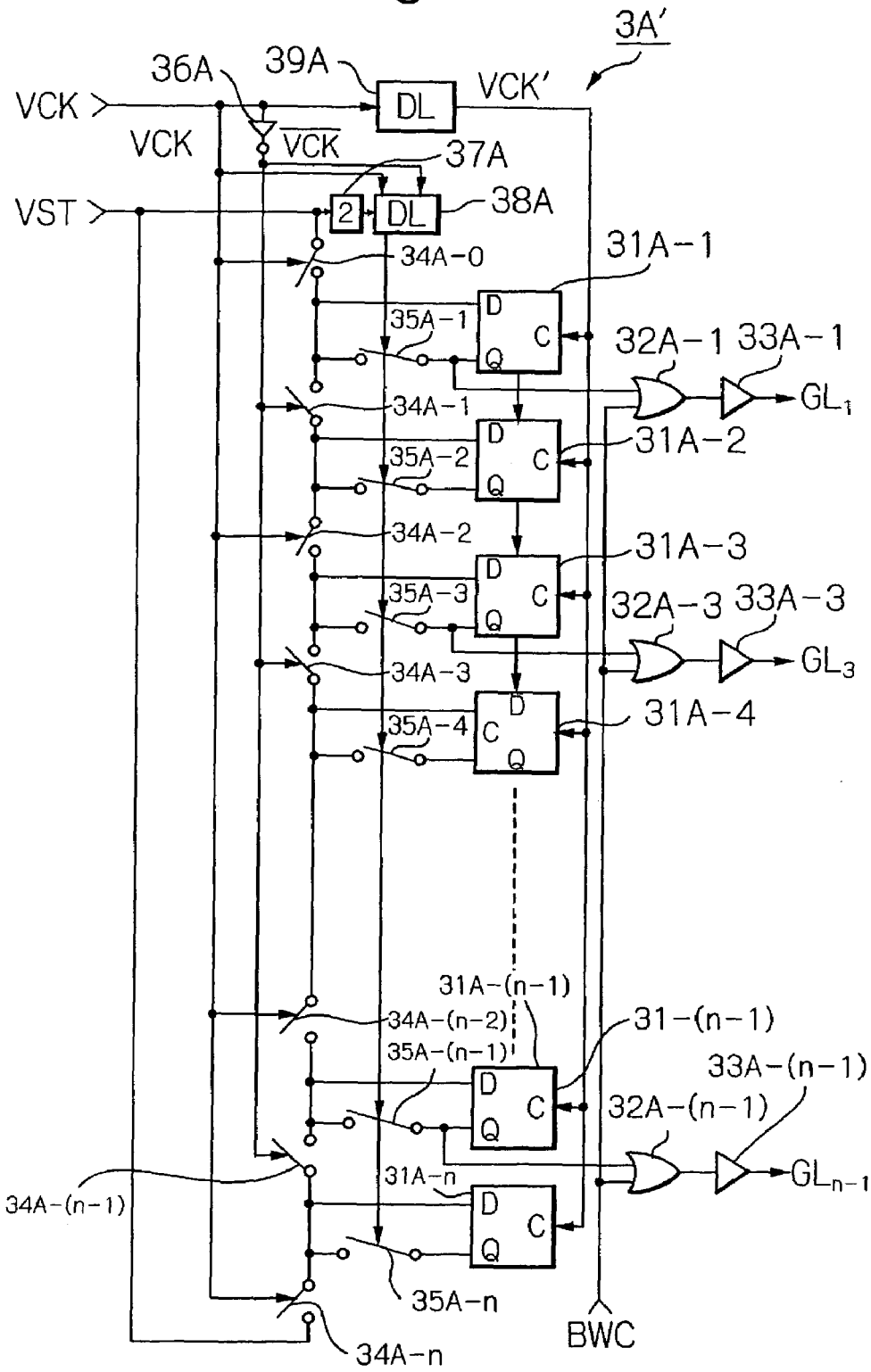
FIG. 20 is a detailed circuit diagram of the gate driver circuit of FIG. 19.

In FIG. 20, which is a detailed circuit diagram of the gate driver circuit 3A' of FIG. 19, switches 34A-0, 34A-1, 34A-2, 34A-3, . . . , 34A-(n−2), 34A-n, switches 35A-1, 35A-2, 35A-3, 35A-4, . . . , 35A-(n−1), 35A-n, an inverter 36A, a frequency divider 37A, a selector 38A and a delay circuit 39A are added to the elements of FIG. 13. Thus, the shift registers 31A-1, 31A-2, 31A-3, 31A-4, . . . , 31A-(n−1), 31A-n serve as a bidirectional shift circuit.

Figure 22:
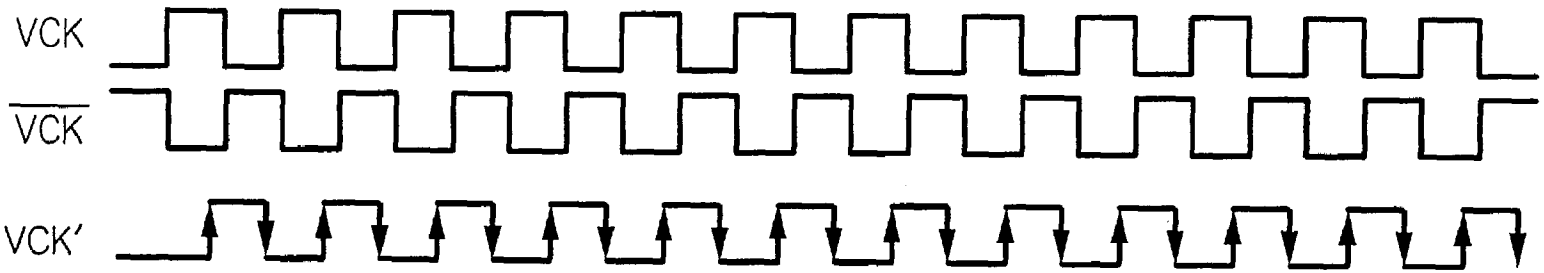
FIG. 22 is a timing diagram showing the clock signals of FIGS. 20 and 21.

In more detail, the switches 34A-0, 34A-2, . . . , 34A-(n−2), 34A-n are controlled by the vertical clock signal VCK as shown in FIG. 22, while the switches 34A-1, 34A-3, . . . , 34A-(n−1) are controlled by an inverted signal $\overline{VCK}$ of the vertical clock signal VCK as shown in FIG. 22.

Also, the switches 35A-1, 35A-2, 35A-3, 35A-4, . . . , 35A-(n−1), 35A-n are controlled by the frequency divider 37A and the selector 38A.

Further, the delay circuit 39A delays the vertical clock signal VCK to generate a vertical clock signal VCK' as shown in FIG. 22.

For example, when a first vertical start signal VST is generated, the selector 38A selects the inverted signal of the vertical clock signal VCK, so that the switches 35A-1, 35A-2, 35A-3, 35A-4, . . . , 35A-(n−1), 35A-n synchronize with the switches 34A-1, 34A-3, . . . , 34A-(n−1). As a result, the vertical start signal VST is shifted through the shift registers 31A-1, 31A-2, 31A-3, 31A-4, . . . , 31A-(n−1), 31A-n by the rising and falling edges of the delayed vertical clock signal CK'; that is, the shift registers 31A-1, 31A-2, 31A-3, 31A-4, . . . , 31A-(n−1), 31A-n carry out a descending shift operation. Next, when a second vertical start signal VST is generated, the selector 38A selects the vertical clock signal VCK, so that the switches 35A-1, 35A-2, 35A-3, 35A-4, . . . , 35A-(n−1), 35A-n synchronize with the switches 34A-0, 34A-2, . . . , 34A-n. As a result, the vertical start signal VST is shifted through the shift registers 31A-n, 31A-(n−1), . . . , 31A-4, 31A-3, 31A-2, 31A-1 by the rising and falling edges of the delayed vertical clock signal CK'; that is, the shift registers 31A-1, 31A-2, 31A-3, 31A-4, . . . , 31A-(n−1), 31A-n carry out an ascending shift operation.

Figure 21:
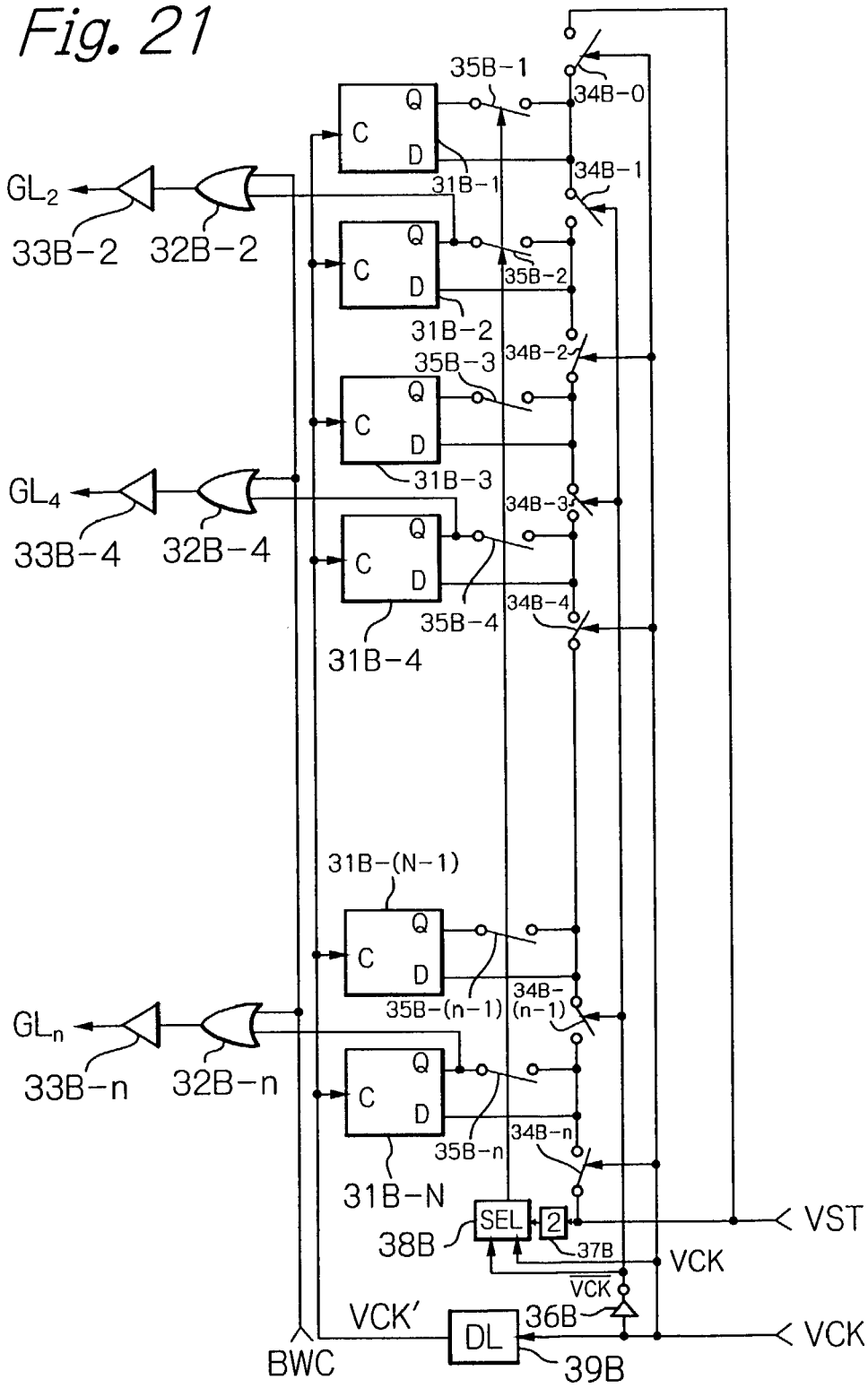
FIG. 21 is a detailed circuit diagram of the gate driver circuit of FIG. 19.

In FIG. 21, which is a detailed circuit diagram of the gate driver circuit 3B' of FIG. 19, switches 34B-0, 34B-1, 34B-2, 34B-3, . . . , 34B-(n−1), 34B-n, switches 35B-1, 35B-2, 35B-3, 35B-4, . . . , 35B-(n−1), 35B-n, an inverter 36B, a frequency divider 37B, a selector 38B and a delay circuit 39B are added to the elements of FIG. 14. Thus, the shift registers 31B-1, 31B-2, 31B-3, 31B-4, . . . , 31B-(n−1), 31B-n serve as a bidirectional shift circuit.

In more detail, the switches 34B-0, 34B-2, . . . , 34B-(n−2), 34B-n are controlled by the vertical clock signal $\overline{VCK}$ as shown in FIG. 22, while the switches 34B-1, 34B-3, . . . , 34B-(n−1) are controlled by an inverted signal of the vertical clock signal VCK as shown in FIG. 22.

Also, the switches 35B-1, 35B-2, 35B-3, 35B-4, . . . , 35B-(n−1), 35B-n are controlled by the frequency divider 37B and the selector 38B.

Further, the delay circuit 39B delays the vertical clock signal VCK to generate a vertical clock signal VCK' as shown in FIG. 22.

For example, when a first vertical start signal VST is generated, the selector 38B selects the inverted signal of the vertical clock signal VCK, so that the switches 35B-1, 35B-2, 35B-3, 35B-4, . . . , 35B-(n−1), 35B-n synchronize with the switches 34B-1, 34B-3, . . . , 34B-(n−1). As a result, the vertical start signal VST is shifted through the shift registers 31A-n, 31A-(n−1), . . . , 31A-4, 31A-3, 31A-2, 31A-1 by the rising and falling edges of the delayed vertical clock signal VCK; that is, the shift registers 31A-n, 31A-(n−1), . . . , 31A-4, 31A-3, 31A-2, 31A-1 carry out an ascending shift operation. Next, when a second vertical start signal VST is generated, the selector 38B selects the vertical clock signal VCK, so that the switches 35B-1, 35B-2, 35B-3, 35B-4, . . . , 35B-(n−1), 35B-n synchronize with the switches 34B-0, 34B-2, . . . , 34B-n. As a result, the vertical start signal VST is shifted through the shift registers 31B-1, 31B-2, 31B-3, 31B-4, . . . , 31B-(n−1), 31B-n by the rising and falling edges of the delayed vertical clock signal VCK; that is, the shift registers 31B-1, 31B-2, 31B-3, 31B-4, . . . , 31B-(n−1), 31B-n carry out an descending shift operation.

Figure 23:
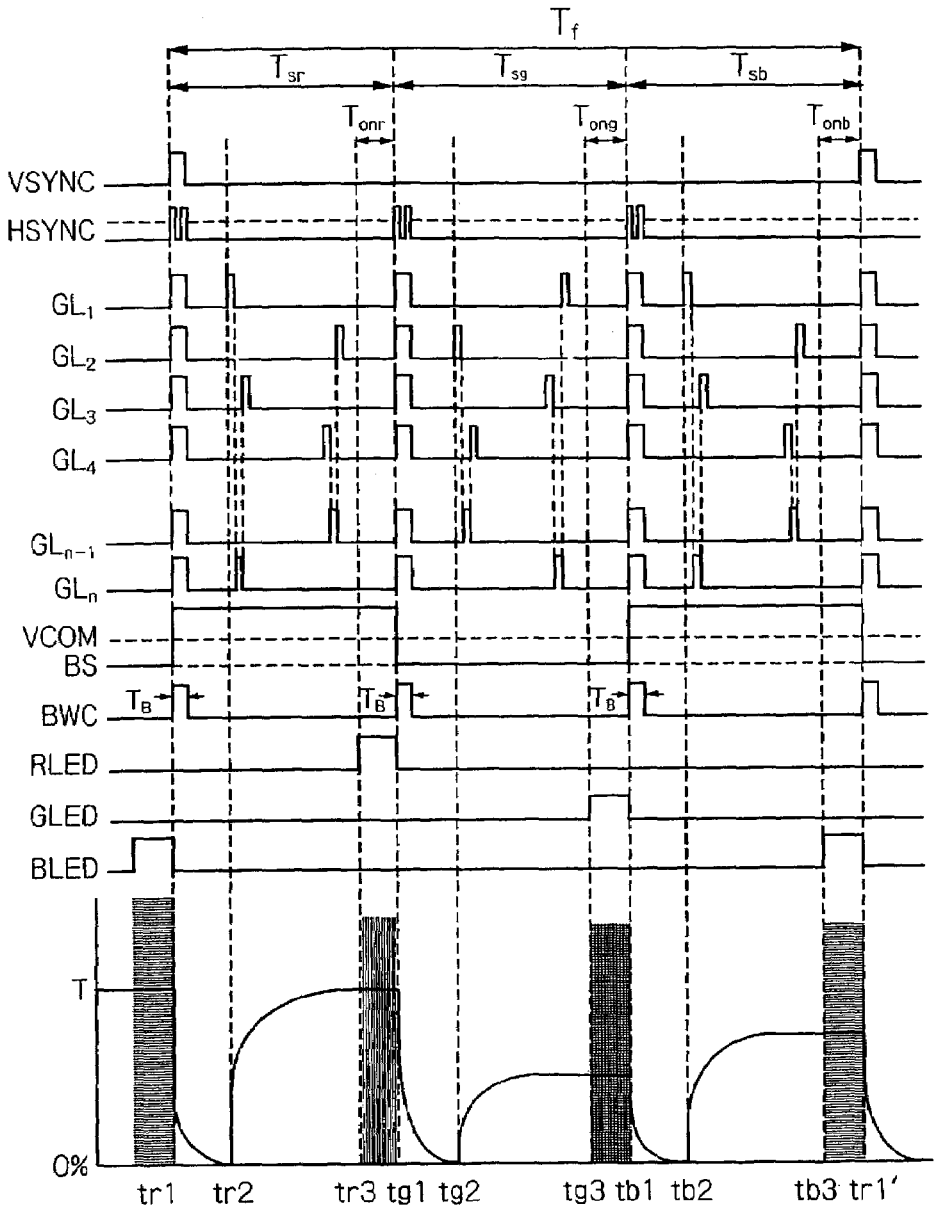
FIG. 23 is a timing diagram for explaining the operation of the LCD apparatus of FIG. 19.

The operation of the LCD apparatus of FIG. 19 will be explained next with reference to FIG. 23. That is, a field sequential operation is carried out, so that one frame $T_f$ for displaying one full-color picture is divided into three fields, i.e., three sub-frames $T_{sr}$, $T_{sg}$ and $T_{sb}$ for displaying the red signal R, the green signal G and the blue signal B, respectively.

Next, at time tg1, the black write control signal BWC is made "1" (high) for a time period $T_B$, so that a black signal is written into all the pixels. Then, at time tg2, video signals of every row are sequentially written into the pixels in accordance with the voltages of the gate lines $GL_2$, $GL_{n-1}$, $GL_4$, . . . , $GL_3$, $GL_n$, $GL_1$. Finally at time tg3, the backlight 5G is turned ON.

Next, at time tb1, the black write control signal BWC is made "1" (high) for a time period $T_B$, so that a black signal is written into all the pixels. Then, at time tb2, video signals of every row are sequentially written into the pixels in accordance with the voltages of the gate lines $GL_1$, $GL_n$, $GL_3$, . . . , $GL_4$, $GL_{n-1}$, $GL_2$. Finally, at time tb3, the backlight 5B is turned ON.

The operation of the signal processing circuit 7C will be explained next with reference to FIG. 24 as well as FIGS. 25A, 25B and 25C. Note that FIG. 25A is a table showing pixel data for one sub-frame, FIG. 25B is a table showing a first transforming function of j to j', and FIG. 25C is a table showing a second transforming function of j to j'.

Figure 16:
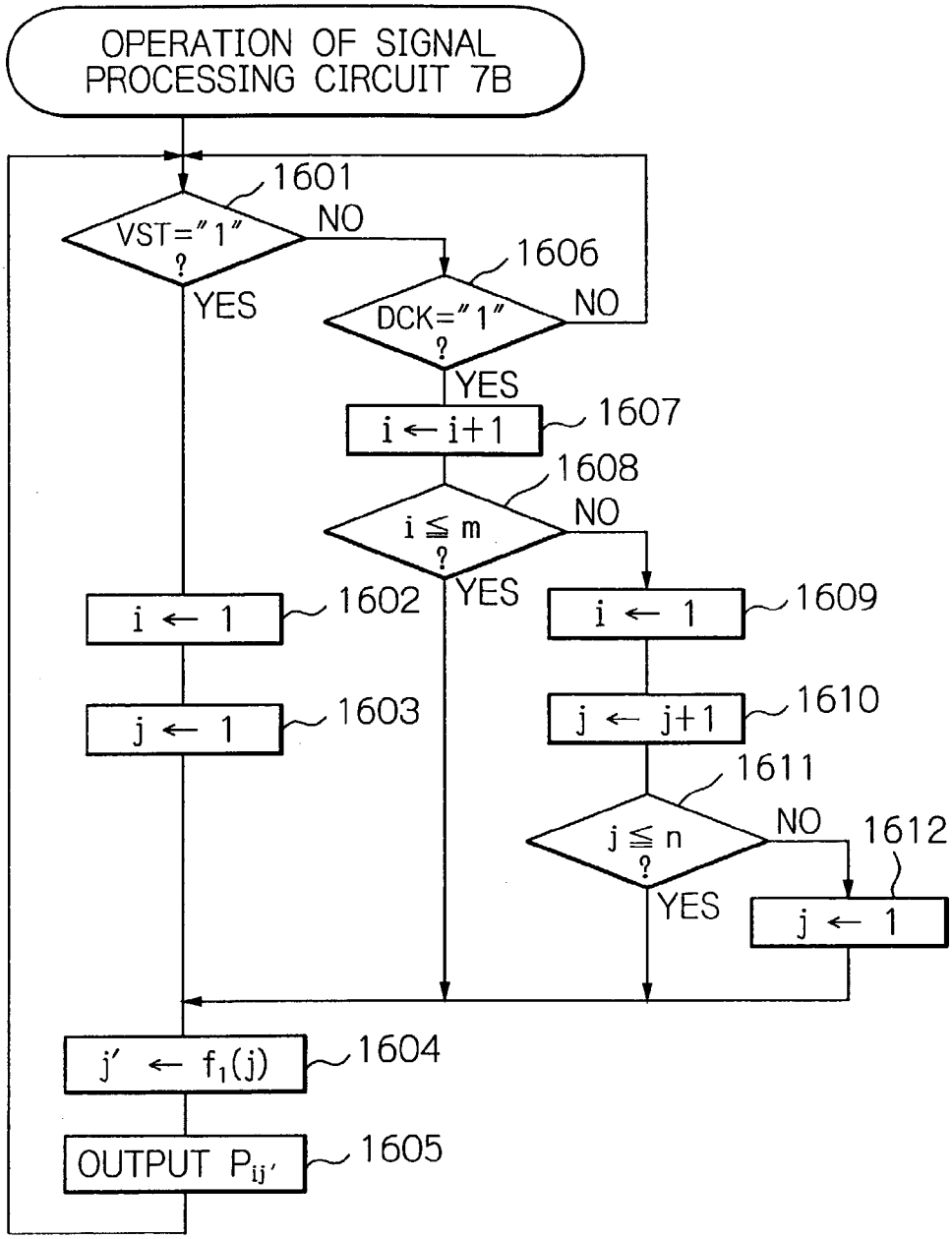
FIG. 16 is a flowchart for explaining the operation of the signal processing circuit of FIG. 12.
Figure 24:
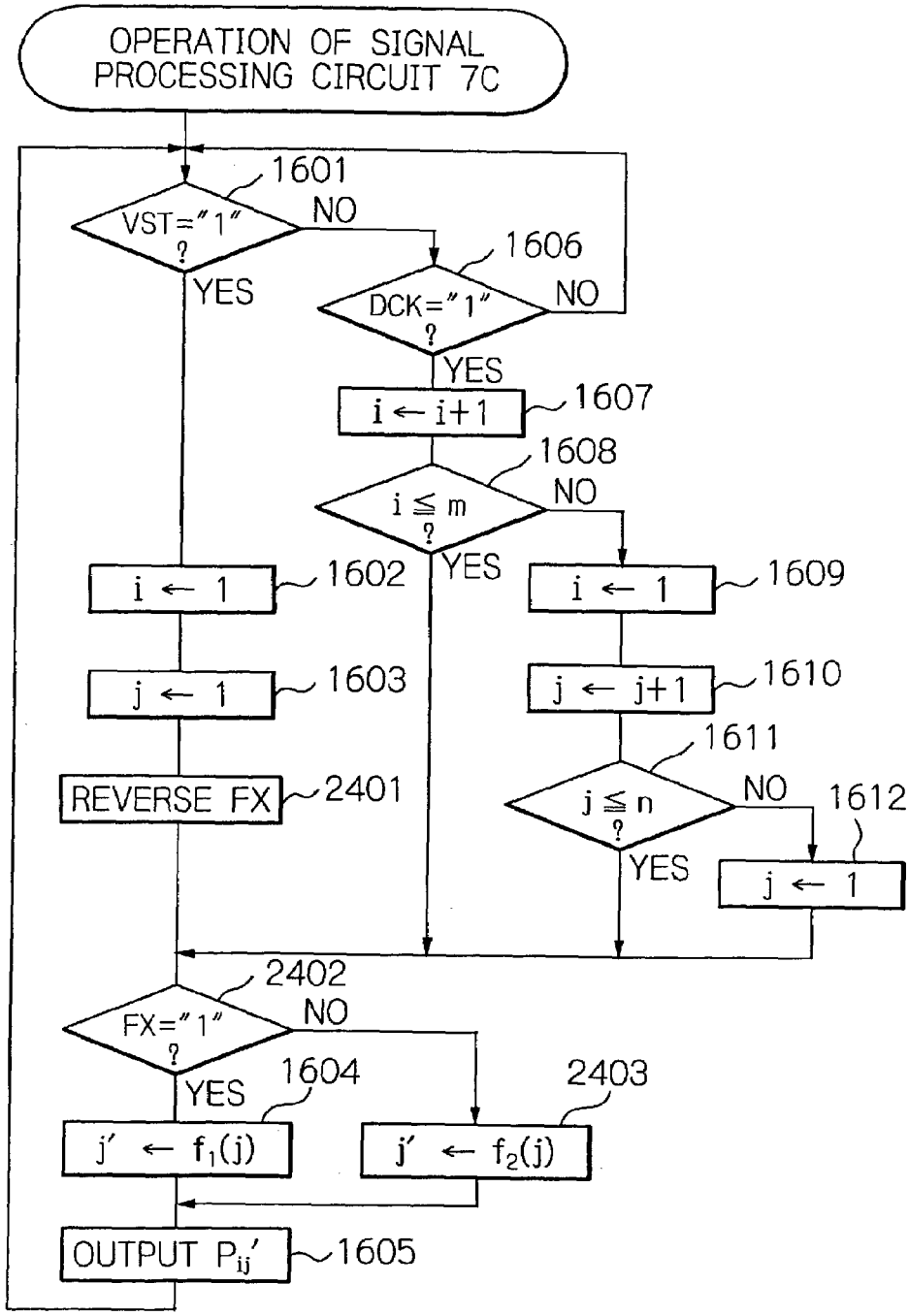
FIG. 24 is a flowchart for explaining the operation of the signal processing circuit of FIG. 19.

In FIG. 24, steps 2401, 2402 and 2403 are added to the flowchart of FIG. 16.

First, at step 1601, it is determined whether or not a vertical start signal VST is received. Only when the vertical start signal VST is received (VST="1"), does the control proceed to steps 1602 and 1603 where values i and j are initialized at 1. Also, at step 2401, a flag FX for indicating the transforming table of FIG. 25B or 25C is reversed. Note that the flag FX is initialized at "0" in advance. Then, the control proceeds to step 2402.

When it is determined what the vertical start signal VST is not received (VST="0") at step 1601, the control proceeds to step 1606 which determines whether or not a data clock signal DCK is received. Only when the data clock signal DCK is received (DCK="1"), does the control proceed to step 1607. Otherwise, the control returns to step 1601.

At step 1607, the value i is incremented by 1, and then, at step 1608, it is determined whether or not $i \leqq m$ is satisfied. Only when $i \leqq m$, does the control proceed directly to step 2402. Otherwise, the control proceeds to step 1609.

At step 1609, the value i is initialized at 1. Then, at step 1610, the value j is incremented by 1, and at step 1611, it is determined whether or not $j \leqq n$ is satisfied. Only when $j \leqq n$ is satisfied, does the control proceed directly to step 2402. Otherwise, the control proceeds to step 1612 which initializes the value j at 1. Then, the control proceeds to steps 2402.

At step 2402, it is determined whether or not the flag FX is "1". When the flag FX is "1", the control proceeds to step 1604 which transforms the value j to j' using the table $f_1$ as shown in FIG. 25B. On the other hand, when the flag FX is "0", the control proceeds to step 2403 which transforms the value j to j' using the table $f_2$ as shown in FIG. 25C. Then, at step 1605 pixel data $P_{ij}'$ is read and transmitted to the D/A converter 8.

Note that the table of FIG. 25B is the same as that of FIG. 17C, and the table of FIG. 25C is the same as that of FIG. 17D. However, the table of FIG. 25B is can be replaced by that of FIG. 17D, and the table of FIG. 25C can be replaced by that of FIG. 17E.

In the LCD apparatus of FIG. 19, since the scanning operation of the gate lines $GL_1$, $GL_2$, . . . , $GL_n$ is switched for every sub-frame, i.e., every color signal, the flicker effect, i.e., the periodic fluctuations of images of the LCD panel due to specific patterns can be suppressed.

Figure 26:
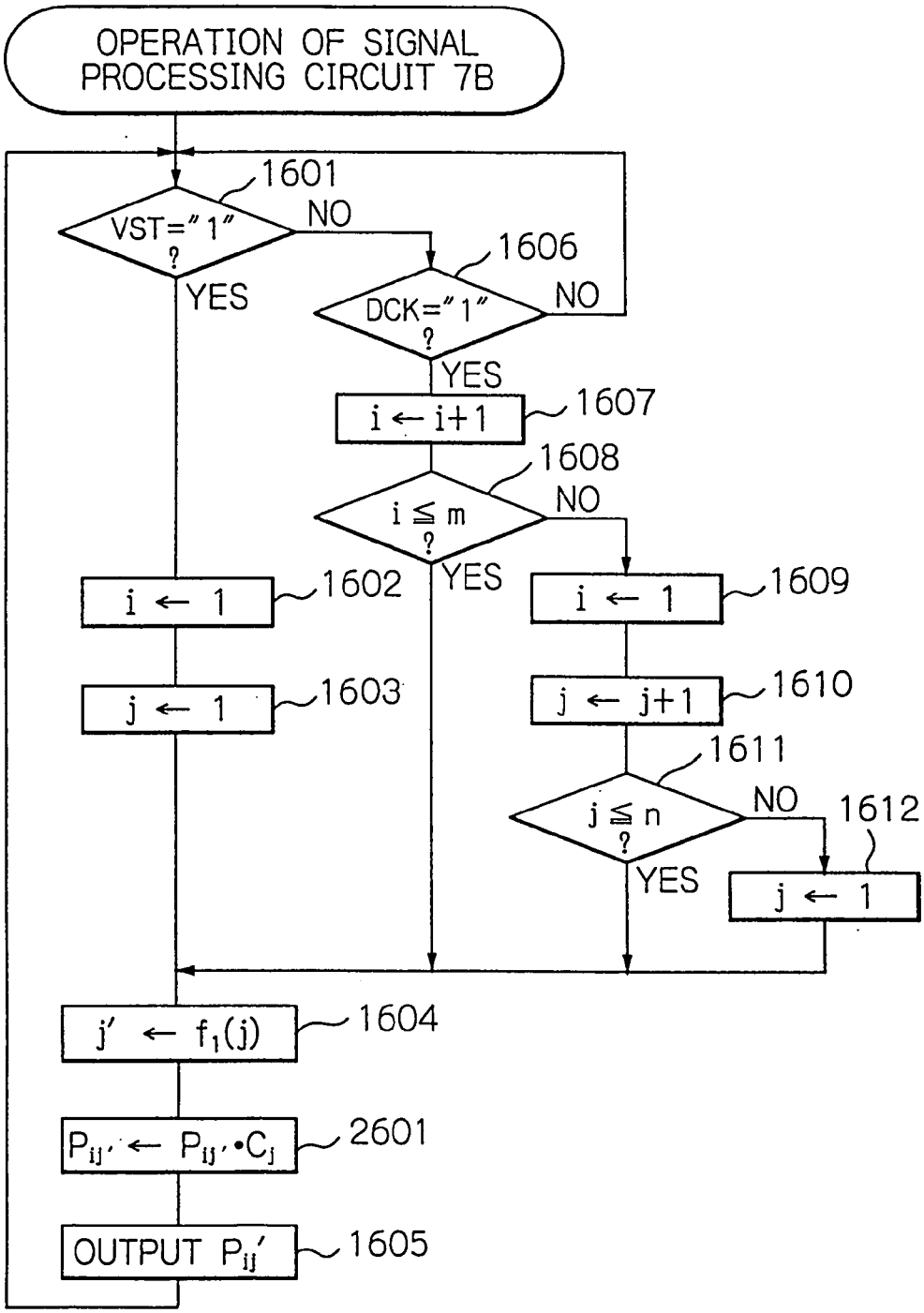
FIGS. 26 and 27 are flowcharts illustrating modifications of the flowcharts of FIGS. 16 and 24, respectively.
Figure 27:
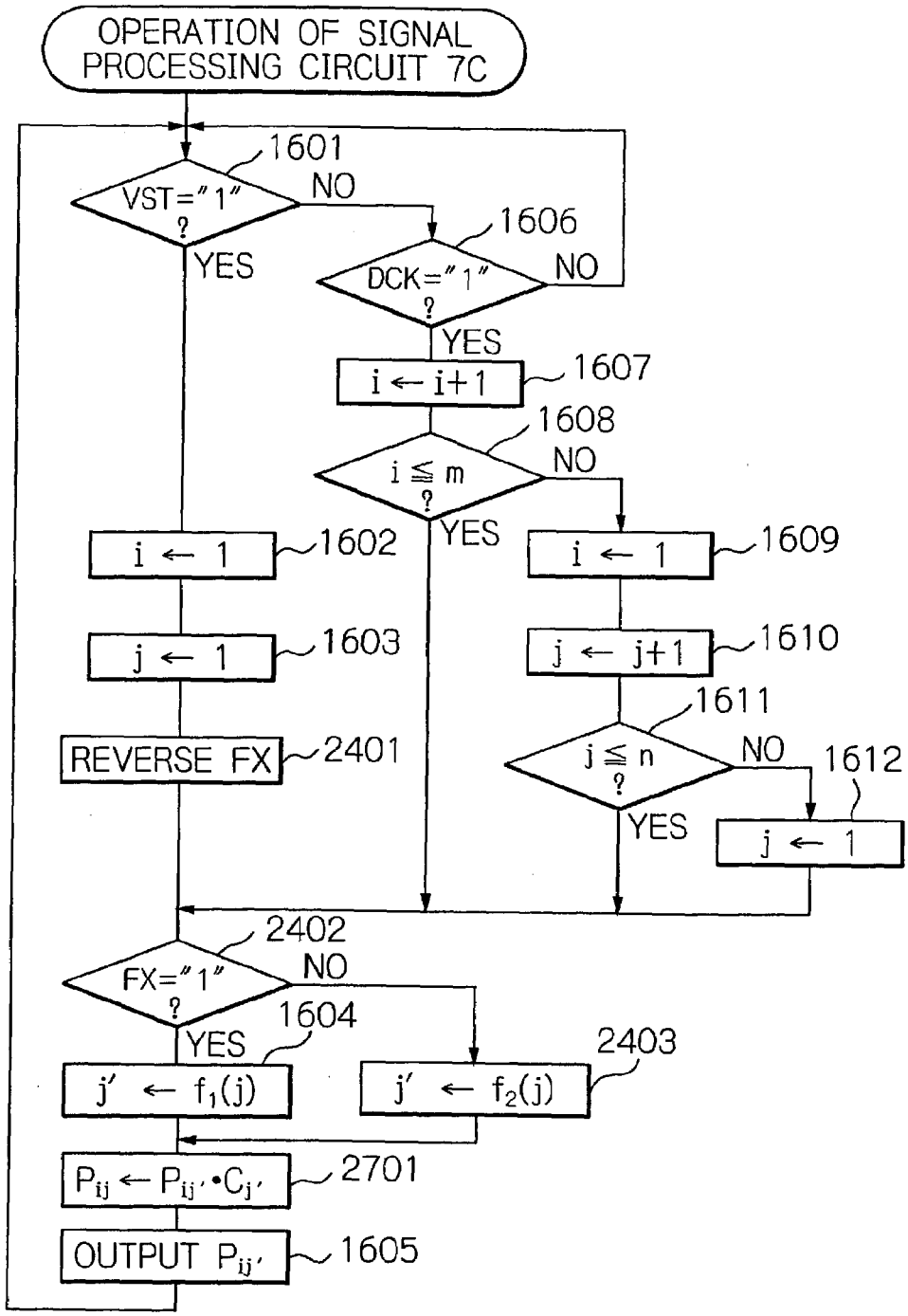

The above-described second and third embodiments can be combined with the first embodiment. In this case, the flowcharts of FIGS. 16 and 24 are modified to FIGS. 26 and 27, respectively, where steps 2601 and 2701 are added to FIGS. 16 and 24, respectively.

As explained hereinabove, according to the present invention, the brightness can be increased. Also, the flicker can be suppressed.

The invention claimed is:

1. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frame;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frames after the one of said color signals is written into all of the rows of said liquid crystal pixels, a level of pixel components of the one of said color signals to be written into one of the rows of said liquid crystal pixels being compensated for, so that a change of an average transmittivity of each of the rows of said liquid crystal pixels is sufficiently small before said end period.

2. The sequential driving method as set forth in claim 1, wherein the level of pixel components of the one of said color signals is compensated for by $$P_{ij} \leftarrow P_{ij} \cdot C_j$$

where $P_{ij}$ is a pixel component of one liquid crystal pixel connected to an i-th one of said data lines and a j-th one of said gate lines selected at a j-th time within the one of said sub-frames, and $C_j$ is a compensating coefficient satisfying $C_j \leqq C_{j+1}$.

3. The sequential driving method as set forth in claim 1, wherein said sequential writing step sequentially selects the 1st, the n-th, the 3rd, the (n−2)-th, . . . , the (n−1)-th and the 2nd gate lines where n is a number of said gate lines and is an even number.

4. The sequential driving method as set forth in claim 1, wherein said sequential writing step sequentially selects the n-th, the 1st, the (n−2)-th, the 3rd, . . . , the 2nd and the (n−1)-th gate lines where n is a number of said gate lines and is an even number.

5. The sequential driving method as set forth in claim 1, wherein said sequential writing step sequentially selects the 2nd, the (n−1)-th, the 4-th, the (n−3)-th, . . . , the n-th and the 1st gate lines where n is a number of said gate lines and is an even number.

6. The sequential driving method as set forth in claim 1, wherein said sequential writing step sequentially selects the (n−1)-th, the 2nd, the (n−3)-th, the 4-th, . . . , the 1st and the n-th gate lines where n is a number of said gate lines and is an even number.

7. The sequential driving method as set forth in claim 1, wherein said sequential writing step sequentially selects the first, the (n−1)-th, the 3rd, the (n−3)-th, . . . , the 2nd and the n-th gate lines where n is a number of said gate lines and is an odd number.

8. The sequential driving method as set forth in claim 1, wherein said sequential writing step sequentially selects the 1st, the n-th, the 3rd, the (n−2)-th, . . . , the (n−1)-th and the 2nd gate lines where n is a number of said gate lines for a first one of said sub-frames and is an even number, and sequentially selects the n-th, the 1st, the (n−2)-th, the 3rd, . . . , the 2nd and (n−1)-th gate lines for a second one of said sub-frames next to said first sub-frame.

9. The sequential driving method as set forth in claim 1, wherein said sequential writing step sequentially selects the 2nd, the (n−1)-th, the 4-th, the (n−3)-th, . . . , the n-th and the 1st gate lines where n is a number of said gate lines for a first one of said sub-frames and is an even number, and sequentially selects the (n−1)-th, the 2nd, the (n−3)-th, the 4-th, . . . , the 1st and the n-th gate lines where n is a number of said gate lines for a second one of said sub-frames next to said first sub-frame.

10. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frame;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frames after the one of said color signals is written into all of the rows of said liquid crystal pixels, wherein said sequential writing step sequentially selects the 1st, the n-th, the 3rd, the (n−2)-th, . . . , the (n−1)-th and the 2nd gate lines where n is a number of said gate lines and is an even number.

11. A sequential driving method for time-divisionally displaying a plurality of color signals in respective ones of sub-frames forming one frame in a liquid crystal display apparatus including a plurality of data lines, a plurality of gate lines, and a plurality of liquid, crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frame after the one of said color signals is written into all of the rows of said liquid crystal pixels, wherein said sequential writing step sequentially selects the n-th, the 1st, the (n−2)-th, the 3rd, . . . , the 2nd and the (n−1)-th gate lines where n is a number of said gate lines and is an even number.

12. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frames after the one of said color signals is written into all of the rows of said liquid crystal pixels, wherein said sequential writing step sequentially selects the 2nd, the (n−1)-th, the 4-th, the (n−3)-th, . . . , the n-th and the 1st gate lines where n is a number of said gate lines and is an even number.

13. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frame after the one of said color signals is written into all of the rows of said liquid crystal pixels, wherein said sequential writing step sequentially selects the (n−1)-th, the 2nd, the (n−3)-th, the 4-th, . . . , the 1st and the n-th gate lines where n is a number of said gate lines and is an even number.

14. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frame after the one of said color signals is written into all of the rows of said liquid crystal pixels, wherein said sequential writing step sequentially selects the 1st, the (n−1)-th, the 3rd, the (n−3)-th, . . . , the 2nd and the n-th gate lines where n is a number of said gate lines and is an odd number.

15. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frames after the one of said color signals is written into all of the rows of said liquid crystal pixels, wherein said sequential writing step sequentially selects the 1st, the n-th, the 3rd, the (n−2)-th, . . . , the (n−1)-th and the 2nd gate lines where n is a number of said gate lines for a first one of said sub-frames and is an even number, and sequentially selects the n-th, the 1st, the (n−2)-th, the 3rd, . . . , the 2nd and (n−1)-th gate lines for a second one of said sub-frames next to said first sub-frame.

16. A sequential driving method for time-divisionally displaying a plurality of color signals in respective ones of sub-frames forming one frame in a liquid crystal display apparatus including a plurality of data lines, a plurality of gate lines, and a plurality of liquid crystal pixels, each including a liquid crystal cell and a switching element connected between said liquid crystal cell and one of said data lines and having a gate connected to one of said gate lines, comprising the steps of:

writing black signals into all of said liquid crystal pixels at a beginning period of each of said sub-frames;

sequentially writing one of said color signals into rows of said liquid crystal pixels each row connected to one of said gate lines while said gate lines are sequentially selected after said black signals are written into all of said liquid crystal pixels; and turning ON a respective one of a plurality of backlights each corresponding to one of said color signals at an end period of each of said sub-frame after the one of said color signals is written into all of the rows of said liquid crystal pixels, wherein said sequential writing step sequentially selects the 2nd, the (n−1)-th, the 4-th, the (n−3)-th, . . . , the n-th and the 1st gate lines where n is a number of said gate lines for a first one of said sub-frames and is an even number, and sequentially selects the (n−1)-th, the 2nd, the (n−3)-th, the 4-th, . . . , the 1st and the n-th gate lines for a second one of said sub-frames next to said first sub-frame.

17. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

a gate driver circuit, connected to said gate lines, for sequentially selecting said gate lines to sequentially write the one of said color signals into rows of said liquid crystal pixels each row connected to one of said gate lines after said black signals are written into all of said liquid crystal pixels;

a backlight control circuit for turning ON a respective one of a plurality of backlights each corresponding to one of said color signals at an end period of each of said sub-frame after the one of said color signals is written into all of the rows of said liquid crystal pixels; and a signal processing circuit, operatively connected to said data driver circuit, for compensating for a level of pixel components of the one of said color signals to be written into one of the rows of said liquid crystal pixels, so that a change of an average transmittivity of each of the rows of said liquid crystal pixels is sufficiently small before said end period.

18. The field sequential driving type liquid crystal display apparatus as set forth in claim 17, wherein said signal processing circuit compensates for the level of pixel components of the one of said color signals by $$P_{ij} \leftarrow P_{ij} \cdot C_j$$

where $P_{ij}$ is a pixel component of one liquid crystal pixel connected to an i-th one of said data lines selected by said data driver circuit and a j-th one of said gate lines selected by said gate driver circuit at a j-th time within the one of said sub-frames, and $C_j$ is a compensating coefficient satisfying $C_j \leqq C_{j+1}$.

19. The field sequential driving type liquid crystal display apparatus as set forth in claim 17, wherein said gate driver circuit comprises first and second gate driver circuits to sequentially select the 1st, the n-th, the 3rd, the (n−2)-th, . . . , the (n−1)-th and the 2nd gate lines where n is a number of said gate lines and is an even number.

20. The field sequential driving type liquid crystal display apparatus as set forth in claim 17, wherein said gate driver circuit comprises first and second gate driver circuits to sequentially select the n-th, the 1st, the (n−2)-th, the 3rd, . . . , the 2nd and the (n−1)-th gate lines where n is a number of said gate lines and is an even number.

21. The field sequential driving type liquid crystal display apparatus as set forth in claim 17, wherein said gate driver circuit comprises first and second gate driver circuits to sequentially select the 2nd, the (n−1)-th, the 4-th, the (n−3)-th, . . . , the n-th and the 1st gate lines where n is a number of said gate lines and is an even number.

22. The field sequential driving type liquid crystal display apparatus as set forth in claim 17, wherein said gate driver circuit comprises first and second gate driver circuits (3A, 3B) to sequentially select the (n−1)-th, the 2nd, the (n−3)-th, the 4-th, . . . , the 1st and the n-th gate lines where n is a number of said gate lines and is an even number.

23. The field sequential driving type liquid crystal display apparatus as set forth in claim 17, wherein said gate driver circuit comprises first and second gate driver circuits to sequentially select the first, the (n−1)-th, the 3rd, the (n−3)-th, . . . , the 2nd and the n-th gate lines where n is a number of said gate lines and is an odd number.

24. The field sequential driving type liquid crystal display apparatus method as set forth in claim 17, wherein said gate driver circuit comprises first and second gate driver circuits to sequentially select the 1st, the n-th, the 3rd, the (n−2)-th, . . . , the (n−1)-th and the 2nd gate lines for a first one of said sub-frames where n is a number of said gate lines and is an even number, and to sequentially select the n-th, the 1st, the (n−2)-th, the 3rd, . . . , the 2nd and (n−1)-th gate lines for a second one of said sub-frames next to said first sub-frame.

25. The field sequential driving type liquid crystal display apparatus as set forth in claim 17, wherein said gate driver circuit comprises first and second gate driver circuits to sequentially select the 2nd, the (n−1)-th, the 4-th, the (n−3)-th, . . . , the n-th and the 1st gate lines where n is a number of said gate lines for a first one of said sub-frames and is an even number, and to sequentially select the (n−1)-th, the 2nd, the (n−3)-th, the 4-th, . . . , the 1st and the n-th gate lines for a second one of said sub-frames next to said first sub-frame.

26. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said crystal cell and one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a black light control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the 1st, the n-th, the 3rd, the (n−2)-th, . . . , the (n−1)-th and the 2nd gate lines where n is a number of said gate lines and is an even number.

27. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the n-th, the 1st, the (n−2)-th, the 3rd, . . . , the 2nd and the (n−1)-th gate lines where n is a number of said gate lines and is an even number.

28. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the 2nd, the (n−1)-th, the 4-th, the (n−3)-th, . . . , the n-th and the 1st gate lines where n is a number of said gate lines and is an even number.

29. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said date lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the (n−1)-th, the 2nd, the (n−3)-th, the 4-th, . . . , the 1st and the n-th gate lines where n is a number of said gate lines and is an even number.

30. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said date lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the 1st, the (n−1)-th, the 3rd, the (n−3)-th, . . . , the 2nd and the n-th gate lines where n is a number of said gate lines and is an odd number.

31. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting said gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the 1st, the n-th, the 3rd, the (n−2)-th, . . . , the (n−1)-th and the 2nd gate lines where n is a number of said gate lines for a first one of said sub-frames and is an even number, and sequentially select the n-th, the 1st, the (n−2)-th, the 3rd, . . . , the 2nd and the (n−1)-th gate lines for a second one of said sub-frames next to said first sub-frame.

32. A field sequential driving type liquid crystal display apparatus for time-divisionally displaying a plurality of color signals in respective ones of sub-frames forming one frame, comprising:

a plurality of data lines;

a plurality of gate lines;

a plurality of liquid crystal pixels, each including a liquid crystal cell and a switching element connected between said liquid crystal cell and one of said data lines and having a gate connected to one of said gate lines;

a black write circuit, connected to said data lines, for writing black signals into all of said liquid crystal pixels at a beginning period of each of said sub-frames;

a data driver circuit, connected to said data lines, for supplying one of said color signals to said data lines;

first and second gate driver circuits, connected to said gate lines, for sequentially selecting gate lines to sequentially write one of said color signals into rows of said liquid crystal pixels each row connected to one of said gate lines after said black signals are written into all of said liquid crystal pixels; and a backlight control circuit for turning ON a respective one of a plurality of backlights each corresponding to one of said color signals at an end period of each of said sub-frames after the one of said color signals is written into all of the rows of said liquid crystal pixels, wherein said first and second gate driver circuits sequentially select the 2nd, the (n−1)-th, the 4-th, the (n−3)-th, . . . , the n-th and the 1st gate lines where n is a number of said gate lines for a first one of said sub-frames and is an even number, and sequentially select the (n−1)-th, the 2nd, the (n−3)-th, the 4-th, . . . , the 1st and the n-th gate lines for a second one of said sub-frames next to said first sub-frame.

* * * * *